US007152528B2

(12) United States Patent
Hesterman

(10) Patent No.: US 7,152,528 B2
(45) Date of Patent: Dec. 26, 2006

(54) DIGITAL PRINTING MACHINE

(76) Inventor: Ebe Hesterman, Curiestraat 7, NL-1171 BG Badhoevedorp (NL)

( * ) Notice: Subject to any disclaimer, the term of this patent is extended or adjusted under 35 U.S.C. 154(b) by 167 days.

(21) Appl. No.: 10/489,182

(22) PCT Filed: Jul. 15, 2003

(86) PCT No.: PCT/EP03/07656

§ 371 (c)(1),
(2), (4) Date: Mar. 10, 2004

(87) PCT Pub. No.: WO2004/007201

PCT Pub. Date: Jan. 22, 2004

(65) Prior Publication Data

US 2005/0145128 A1 Jul. 7, 2005

(30) Foreign Application Priority Data

Jul. 16, 2002 (DE) ..... 102 32 864
Mar. 18, 2003 (DE) ..... 103 12 870

(51) Int. Cl.
*B41F 13/193* (2006.01)
*B41F 21/10* (2006.01)
*B41F 21/08* (2006.01)
*G03G 15/00* (2006.01)

(52) U.S. Cl. ..... 101/246; 101/232; 101/376; 101/408; 101/409; 399/388; 399/397

(58) Field of Classification Search ..... 346/103
See application file for complete search history.

(56) References Cited

U.S. PATENT DOCUMENTS 5,602,624 A * 2/1997 Coburn et al. ..... 347/2
6,161,928 A * 12/2000 Morikawa et al. ..... 347/96
6,173,147 B1 * 1/2001 Nakashima et al. ..... 399/308
6,679,597 B1 * 1/2004 Ohsawa et al. ..... 347/95
6,996,361 B1 * 2/2006 Ichida et al. ..... 399/302
2004/0175208 A1 * 9/2004 Ichida et al. ..... 399/302

FOREIGN PATENT DOCUMENTS

DE 19745136 A1 * 4/1998
DE 199 51 283 5/2000
EP 737572 A1 * 10/1996
EP 0 899 095 3/1999
JP 2001305887 A * 11/2001

* cited by examiner

*Primary Examiner*—Daniel J. Colilla
(74) *Attorney, Agent, or Firm*—Paul Vincent

(57) ABSTRACT

The invention concerns a digital printing machine for sheet printing with a digital printing mechanism with free format in the peripheral direction, an intermediate cylinder which is connected downstream of the digital printing mechanism and is at least partially coated with an elastic material, and a counterpressure cylinder which is connected downstream of the intermediate cylinder, wherein the counterpressure cylinder has grippers holding the sheet and the intermediate cylinder periphery is provided with recesses for receiving the grippers.

17 Claims, 21 Drawing Sheets

DIGITAL PRINTING MACHINE

This application is the national stage of PCT/EP03/007656 filed on Jul. 15, 2003 and also claims Paris Convention priority of DE 102 32 864.1 filed on Jul. 16, 2002 and DE 103 12 870.0 filed on Mar. 18, 2003.

BACKGROUND OF THE INVENTION

The invention concerns a device for indirect digital front and back side printing of multicolored pictures onto sheets using single shot and single pass methods.

Packaging and label printing are currently growing markets. The packaging market is expected to double within the next five years through the influence of Eastern Europe, South-East Asia and China, wherein plastic materials, sandwich materials and metallized substrates will be increasingly used. The worldwide turnover with packaging printing machines is about one billion Euros (Deutsche Drucker No. 4 of Feb. 6, 2003).

The packaging market poses the highest demands concerning printing and finishing quality. In jobbing (commercial), almost everything is printed with standard process colors, optionally extended by a customer-specific pantone color. In packaging printing many more pantone colors are used, either exclusively or as a supplement to the process colors.

Conventional sheet-fed offset machines are classified by the maximum printable sheet format in accordance with format classes with the following variants:

| | |
|---|---|
| Small format | 353 × 500 (B3) |
| Semi-format | 500 × 707 (B2) |
| Medium format | 707 × 1000 (B1) |
| Large format | 1000 × 1414 (B0) |

In conventional sheet printing machines in accordance with the offset or book printing method, picture-carrying plates are used in dependence on the format class, which must be exchanged when the motive or order changes. The illustrating or plate cylinders comprise a tensioning channel, which is also format-dependent, and mostly comprise demanding semi-automatic plate exchange systems.

For printing, it is standard to add a particular customer-specific color to the four process colors cyan, magenta, yellow and black (C, M, Y, K). The CYMK color space is likely to preclude readjustment of the pantone reference value. To obtain a larger color range for multi-color printing, complementary red, green and blue (R.G.B) are additionally increasingly used for the 7-color HIFICOLOR system or the additional colors orange and green are used for 6 color hexachrome systems. This is advantageous in that 95% of the pantone colors can be printed without requiring the hitherto associated time-consuming cleaning of the printing mechanism for a new order. This is also confirmed by the increasing application of sheet-fed offset machines with 8 and 10 printing mechanisms, not only for double-face 4-color printing but also for matrix printing with additional colors for this so-called High-Fidelity print.

The color is transferred indirectly from the printing plate to the material to be printed via the (exchangeable) rubber blanket thereby compensating for unevenness of the material to be printed. Surfaces and matrix points are transferred almost as if the material to be printed had an ideal flat surface which permits processing of a large range of printing materials.

This also prolongs the service life of the illustrating cylinders, the transfer band or the transfer drum, since they are not in direct contact with the abrasive surface of the printed material.

The system is very precise (±0.1 mm) since the substrate sheets are aligned through side and front lay marks when the system is stopped.

The printed sheets are transferred from the feeder pile to the first printing mechanism, from printing mechanism to printing mechanism and from the last printing mechanism to the delivery pile using gripping technology which is integrated in the counterpressure cylinder channel or in a chain carrier, in dependence on the format. This means that the separation between a gripper system and the neighboring gripper system is always equal to the maximum printing format in the peripheral direction.

Flexo lacquering mechanisms with fixed format are increasingly integrated in printing machines, since application of a lacquer layer considerably increases the quality of the prints, e.g. protects the printed material and improves further printing processing or e.g. spot lacquering for optical effects.

A further development concerns application of a primer (with primer in the Flexo method) before and after printing e.g. for printing plastic materials with hybrid printing systems, i.e. the combination of different printing methods in one printing machine (U.S. Pat. No. 6,443,058 B1).

NIP methods for personalization (DE 100 47 040 A1), punching units (DE 101 47 486 A1) for further processing, embossing units for haptic effects (Look and Feel) and Inline Finishing (EP 80 929 091 A1) e.g. for folding have recently been integrated in the chain of process consolidation. The above-described combination of high-quality printing, finishing and further processing methods also requires relatively demanding drying systems which results in machine lengths of up to approximately 35 meters, as reported in Druckspiegel No. 5, May 2002 SM Type CD 102 LY-6-LYYLX of the company Thomas in Gelsenkirchen as well as by COMPRESS Magazin on Apr. 6, 2003, concerning a KBA Rapida 142 sheet-fed offset machine having a format of 102×140 and a length of 37.5 meters in Illinois (USA). This machine comprises 7 offset printing mechanisms, one lacquer printing mechanism, intermediate drying and last printing mechanism, including a turning device. These highly demanding machines require i.a. expensive automation and drive concepts with e.g. double drives having toothed wheel tension and cardan shafts as well as several intermediate and final dryers (DE 199 12 309 A1). Without such devices, this technology could not be mastered.

Sheet turning systems are also often integrated in the sheet printing machines to print both the front and the back sides in one process.

For the above-mentioned reasons, a great amount of space is required which poses substantial problems, i.a. to a desired one-man operation, and involves new investment for the extension of the premises. In conventional applications, compact machines of satellite structure are used for small formats, with the number of printing mechanisms being limited to 4. For small, semi-, medium and large formats, modular structures for series construction are therefore frequently used which have their own construction module for each printing mechanism.

For both conventional machine concepts, format-related conventional offset or letterpress plate cylinders having tensioning channels are used. FIGS. 15 and 16 show that the use of 2×7 printing mechanisms of half-size portrait (with 345 mm diameter) would produce ergonomically unrealistic dimensions with this concept and for modular as well as satellite structures, additional modules, e.g. roll unwinding or for finishing or for further processing, are also unrealistic.

In view of the technical effort of conventional printing technologies, and due to the fact that one expects, due to the influence of "POD" (print on demand) or just in-time production, that 90% of all jobbing and a considerable part of packaging printing orders will involve less than 5000 sheets, it becomes clear that other printing machine concepts must be invented to ensure economic future production.

For digital printing machines, a nearly offset-like quality with maximum flexibility is generally obtained in prior art, since each sheet can be continuously printed with another motive if required without losing time for adjustments and without having to change plates. To optimally utilize the data processing speed, the digital printing machines are designed for portrait format processing. The digital printing method requires no demanding radiation and dryer systems, thereby facilitating processing consolidation with additional processing steps. For this reason, the digital printing method is well suited for printing small runs of small formats (currently max. A3 format, approximately 330×460 mm).

Most digital printing machines have paper transport systems e.g. using transport bands (DE 195 36 309 A1). Grippers are not used for transfer of the sheet (except for WO 96/17277). This limits the precision of the color register required (±0.01 mm) and the feed register (±0.1 mm). The tolerances of the feed and transfer passers (color register) are generally larger by approximately a factor of 2 to 4 compared to printing methods using conventional feeding and gripper technology such as e.g. sheet-fed offset printing. These large tolerances (image drift) in digital printing require complicated systems to compensate for, or to attempt to compensate for, these tolerances (image drift) in inline finishing.

More digital printing machines must be used which are suitable for the POD market. The limited technical features preclude use in the graphics industry (Report Pira International Ltd. 2002 ISBN 185824641). Digital machines without grippers are mainly limited by the maximum format size, production speed, flexibility of the material to be printed and feed passer.

It is therefore the object of the invention to develop a new generation of printing machines to meet the new market demands for maximum quality with minimum copies for POD and just in time systems, wherein the advantages of the conventional sheet-fed offset technology and new digital technology must be utilized to ensure future economical production. The requirements are listed below:

1. 1 to 7 digital printing mechanisms with upstream cleaning station for hexachromes or Hifi color print, using single shot and single pass methods;
2. integrated finishing with protective lacquer (100% of the packagings require protective lacquer on one side) and alternatively full-surface lacquer finishing for jobbing printing mechanisms and/or special spot effect lacquer (approximately 20 to 30% of the orders of a jobbing print are lacquered);
3. the possibility of personalization or printing of variable data;
4. indirect print through exchangeable rubber blankets to compensate for unevenness in the material to be printed;
5. a format class which is larger than the small format (approximately 36×50 cm), preferably a 50×70, 70×100 format;
6. the possibility of printing plastic material and sandwich substrates;
7. full-format duplex print on front and rear side without turning and at full production speed (for jobbing prints approximately 90 duplex is printed and for packagings approximately 5 to 10 is printed and/or finished. (e.g. rear side print with instructions, safety features or protective lacquer or coating for the inside of the packaging);
8. uniform printing methods for printing, coating and finishing to permit automation and reduce the requirements for operator skill;
9. high-quality sheet alignment and gripper sheet transport systems for feed and transfer passers, similar to sheet-fed offset, with minimum gripper change or gripper transfer;
10. high-quality arrangement of the printing cylinders preferably with counterpressure cylinder of twice the periphery and delivery arrangement in the so-called 7-o'clock position to permit perfect undistorted printing (tangent function);
11. high-quality arrangement and drive of the printing cylinders for extremely high register accuracy on one side for multi-color print and also between front and rear side print.
12. Straight (minimized) sheet guidance for maximum flexibility of the material to be printed and for separating the sheet from the rubber blanket cylinder with minimum force;
13. Stability with minimum operating oscillation for optimum printing quality despite tensioning channels in the intermediate or rubber blanket cylinder for use of novel liquid toner, which requires more pressure than dry toners;
14. Sheet guidance without blotting;
15. Good accessibility of the individual machine elements;
16. Inline finishing with exact register through gripper transfer such as e.g. hot foil embossing and/or punching and/or piling or inline folding or inline book binding;
17. Complete utilization of the synergy of common parts, modules and software of a family of printing machines for inexpensive mass production;
18. One size for one-man operation, preferably one machine length of a maximum of approximately 7 m and a machine height of a maximum of approximately 2.75 m.

U.S. Pat. No. 5,016,056 discloses principal prior art which is not based on indirect print transfer via an intermediate carrier or rubber blanket cylinder. Printing is effected directly from the illustrating cylinder. This lacks the advantages of indirect printing via rubber-coated intermediate cylinders, in particular, advantageous printing on uneven substrate surfaces and the associated increased flexibility with respect to the material to be printed.

CH 116 828 describes conventional offset printing mechanisms with format-dependent plate and rubber blanket cylinders which therefore both have tensioning channels. A 2×7 color printing machine of medium format is excessively large for both a satellite as well as a modular arrangement (FIGS. 15 and 16). Change of motif requires demanding plate change and in most cases rinsing of the printing mechanism for other customer-specific pantone colors.

Neither does DE 100 47 040 A1 discuss digital printing mechanisms, rather offset printing mechanisms which are digitally exposed online, however, using conventional plate and rubber blanket cylinders which are format-dependent and have the above-mentioned disadvantages.

DE 21 15 790 A1 also describes conventional offset and/or letterpress printing i.e. with format-related plate cylinders having tensioning channels and the above-mentioned disadvantages.

DE 199 12 309 A1 provides an example of a machine of modular structure (U.S. Pat. No. 6,443,058 B1) which is excessively long (approximately 25 m). DE 100 47 040 A1 suggests a satellite arrangement with only 4 printing mechanisms and a connected printing mechanism with coupling means required therefor. This machine disadvantageously requires a second passage for the second print (approximately 90–95% of the jobbing prints are front and back side prints) and is also not suited for 7 color print with subsequent finishing.

DE 21 15 790 A1 describes a construction or printing machine concept, which permits duplex printing in one process but which is a combination of format-dependent plate imaging systems combined with conventional format-dependent rubber blanket cylinders. This construction does not permit integration of up to 2×7 printing mechanisms or even further modules for coating without creating unacceptable handling and engagement problems (FIG. 15). This factor is of particular importance since conventional digital printing mechanisms are based on portrait printing (i.e. printing of a page in a vertical orientation), in contrast to landscape printing in conventional sheet-fed offset printing (i.e. printing of a printed page in a horizontal orientation). Moreover, additional space must be reserved for format-related illustrating cylinders or drums for access, e.g. for plate and/or rubber blanket replacement. For this reason, the maximum satellite arrangement is considered to be 4 printing mechanisms (DE 43 03 796 A1). CH 116,828 also discloses plate and rubber blanket cylinder constructions with bound format for tensioning imaging plates and rubber blankets. The format-related technology does not permit extension to 2×7 printing mechanisms with cleaning systems or even additional mechanisms for finishing.

Conventional satellite printing machines (WO 01/39976 A1) do not take into consideration the above-mentioned requirements of digital printing with regard to format-independent illustrating cylinders. Illustrating cylinders of fixed format are used which therefore cannot utilize the considerably compact construction of the inventive machine.

U.S. Pat. No. 5,016,056 discloses sheet transport without formatted gripper systems and avoids use of highly precise sheet gripper transport systems with projecting gripper backs which would damage the illustrating cylinder, by using a vacuum strip which holds the sheet on the feed side without protruding. The production tolerances of the feed passer can be expected to vary by a factor of between 2 and 4—larger for the sheet feed and transport system than for printing methods using conventional gripper technology. Moreover, such systems without grippers are limited with respect to the flexibility of the material to be printed, the sheet format and the sheet thickness of the printing system. The ends of the sheet are also held by vacuum. This is disadvantageous in that only sheets of a fixed peripheral length can be printed ("secures the ends of a receiving sheet").

DE 195 36 359 A1 discloses an endless transport without gripper systems, wherein feed and transport passer tolerances must be expected which are a factor of 2 to 4 times larger than for sheet feeder and transport systems using conventional gripper technology.

CH 116,828 provides duplex printing in one step but only at half the production speed since "a sheet must be supplied at least after every second rotation".

In known satellite printing machines with gripper transport devices according to DE 43 03 796 A1, the number of rubber and plate cylinder pairs disposed about a printing cylinder is limited to four due to the need for access to the printing mechanisms. Front and back side printing (duplex print) therefore require sequential arrangement of two printing mechanisms or twin stations which must be connected via a turning unit as also provided e.g. in U.S. Pat. No. 5,660,108 and DE-PS-435 902.

There are various conventional concepts of digital printing mechanisms for duplex printing (front and rear side printing) e.g. via a turning pocket (U.S. Pat. No. 5,552,875) (which includes the risk of distortions, paper jamming, damage, halved productivity, for limited thicknesses and is not that precise), twin installation (associated with inflexibility, large investment and many gripper transfers) or systems with half the width or half the circumference.

Turning systems are known for sheet printing machines (DE 298 07 663 U1) for printing the first and second side of the sheets (recto verso). These systems are demanding, render the machine inflexible due to their fixed position, are expensive and require a white edge (gripper edge) on both sides of the sheet. Moreover, the registering sheet guidance (turning passer) is extremely difficult and leads to inaccuracies. It also limits the flexibility of the printing material with regard to substrate thickness.

For applications which only require occasional duplex printing, it is, however, feasible to integrate a conventional turning drum system, wherein the above-mentioned disadvantages must be accepted.

EP 819 268 B1 discloses a digital printing mechanism using the so-called multi-pass system, wherein the intermediate cylinder passes several times through the same printing gap and transfers the multicolored image formed on the rubber blanket cylinder onto the printing material when the sheets are supplied in cycles during the so-called single shot procedure. The associated efficiency is therefore very poor. The multiple transfer on the intermediate cylinder could have negative effects on the register accuracy e.g. through slight bulging/speed differences during multiple passage of the printing gaps. The illustrating cylinder is designed for replaceable plates or cylinder milling and has a tensioning channel for tensioning or holding the plate. The so-called photo imaging plate must be regularly replaced due to wear. This construction is bound to a format and for this reason cannot receive more than 4 printing mechanisms when used in a satellite construction due to access needs (replacement of plate and rubber blanket) (DE 43 03 796 A1).

U.S. Pat. No. 6,363,234 B2 discloses a satellite construction with format-related printing mechanisms/print engines which are limited to a maximum of 4 for access reasons. A special turning technique cuts the productivity in half.

The photo conductor drum or illustrating cylinder 52 (FIG. 5), on which the toner image is formed from the charge image derived from the optical image, is the central component in the electro-photographic process.

FIG. 1 shows how the partial colors formed by the individual photo conductor drums S are collected on the rubber blanket segments before being transferred to the printing material (single shot).

Partial colors can also be transferred onto a conducting rubber-like silicon transfer band (FIG. 22) or transfer drum (FIG. 23) or onto a common photo conductor drum and then onto an intermediate cylinder having rubber blanket segments to transfer the collected partial colors to the printed material.

There are a plurality of digital printing techniques for transferring variable data with color onto the material to be printed. The best known methods are inkjet, thermo transfer, thermo sublimation, electro photography, magnetography, ionography and direct imaging technology (U.S. Pat. No. 3,846,840).

Digital printing with gripper sheet transport is not possible, since the transfer band would be damaged by direct contact with the projecting grippers, similar to the photo conductor drum.

It would be feasible to design the rubber-like silicon transfer band or transfer drum or common photo conductor drum to be compressible in order to compensate for unevenness of the substrate, such as for a rubber blanket. If these parts are delivered with format-dependent recesses for the gripper backs, they could be disposed directly on a counterpressure cylinder with gripper transport system (not shown). Bands are, however, not as precise as drums and are moreover limited in length and maximum production speed.

SUMMARY OF THE INVENTION

In the inventive machine concept, the special properties of the photo conductor drum is utilized in an innovative fashion in that it must not coincide with the printing length. The drum diameter may be smaller than the printing length would require, wherein the drum (without tensioning channel) must be imaged through 360° drum rotation to print one page. These photo conductor drums or illustrating cylinders having a peripheral length which is less than the printing length, are of satellite construction with a collecting cylinder or intermediate cylinder having a number of replaceable segmented elastic printing blankets which are regularly disposed about the periphery of the intermediate cylinders, in dependence on the format size. This feature permits very compact innovative construction using gripper sheet transport systems for multi-color Hi-fi printing on the front and rear sides in combination with multiple application of lacquer and with or without inline further processing in one production step (so-called single pass system) with absolutely minimum adjustment times, optimum ergonomic operating conditions (very small footprint) and inexpensive production and operation.

This single shot system, wherein all partial colors and coatings such as e.g. lacquer are transferred at once from the intermediate cylinder to the substrate, like e.g. lacquer, is also particularly advantageous for printing sensitive substrates. When such substrates are printed with partial colors by passing through several printing mechanisms, the substrate material can expand and thereby cause printing passer inaccuracies.

The inventive satellite printing machine has an intermediate cylinder which is formed as rubber blanket cylinder and which can be disposed centrally (see FIGS. 1 or 2) and having at least 1 to 10 associated satellite printing mechanisms for front side printing disposed, in the direction of rotation, between the supply system comprising a supply cylinder or supply rollers and the discharge system, and can cooperate with another 1 to 10 satellite printing mechanisms for back side printing. This machine construction allows one-color or multicolored front side printing and/or back side printing on sheet-shaped printing material which can be printed in one run and without additional turning technology.

In a preferred embodiment, the printing machine may be adjusted to variable thicknesses of the material to be printed via radial adjustment of the supply, printing, intermediate and discharge cylinders (arrow Y).

The compact construction of the satellite printing machine permits printing with uniform feed through conditions for the printing material which precisely passes the intermediate cylinders, appropriately registered through adjustment at standstill using conventional side and front lay marks. For this reason, the inventive satellite printing machine can achieve high cycle times and full printing speed in sheet printing, leading to high printing quality with little adjustment time. This system permits full-format printing of the front and back side printing width of the printed sheet, wherein only one edge strip is required for the gripper which cannot be accessed by the printing surface of a plate cylinder periphery. This considerably reduces paper waste. The satellite printing machine can therefore also be used for printing material which is difficult to handle such as e.g. cardboard, plastic materials, multi-layer packagings or the like. This process is carried out without turning the sheets thereby obtaining more accurate register (passer) tolerances.

A further aspect of the invention consists in finding a novel solution for a digital lacquer application/coating system in a single pass digital printing, partial color transfer system which is not bound to a format, i.e. without using another printing method, since these conventional hybrid machine concepts pose high requirements with respect to operation, cannot be automated through digital workflow, and also have the disadvantage that they are bound to a format as is a conventional sheet-fed offset machine. Additional dryers are also required. The inventive solution permits coating with a (liquid) lacquer toner without pigments. This step can be included in a digital application form (job ticket), such that processing consolidation can be fully automated.

In a further aspect of the above-mentioned invention, the lacquer is applied to the intermediate carrier as a first coating, wherein the partial colors are subsequently transferred and printed on the printing material in the form of multiple layers, in one printing step (single shot). This (dry or liquid) toner without pigments obtains its shine through contact-less and/or mechanical conditioning. The lacquer is used as full-surface protective lacquer and/or as partial spot lacquer. The lacquer coating can also be used as a primer. This lacquer layer could also be used as white lacquer for printing transparent substrates. This lacquer layer can also be used with a so-called UV lacquer for optimum hardness to protect the material to be printed.

In an alternative inventive embodiment, inexpensive imaging cassettes are used only for printing or coating motifs which do not permanently change, e.g. for full-surface support lacquer or full-surface priming.

These inventive digital imaging cassettes are designed like a flexo letterpress printing mechanism with anilox roller and chamber doctoring system. The so-called E-anilox roller, a particular type of photo conductor drum, is adjusted for full-surface application of powder or liquid toner without pigments. In contrast to imaging cassettes for continuous variable imaging, these cassettes have a fixed format. The motive or image change can be carried out only through a slightly more demanding application format change. The construction costs are considerably reduced since no demanding electronic control is required for protective lacquer and primer applications which are principally always full-surface applications. Format-free E-anilox cassettes would also be feasible.

In an advantageous embodiment, the cylinder or chain transfer following the counterpressure cylinders is disposed in the so-called 7 o'clock position such that transfer takes place only after printing the entire sheet format to prevent the so-called tangent function during wrapping, i.e. acceleration and the associated print distortion. The 7 o'clock arrangement can be handled despite the compact dimensions of the machine, which are ergonomically specified, and the "lean" sheet guidance defined by the maximum printing material thickness.

In an advantageous embodiment, the illustrating cylinders each form cassette-shaped construction units (so-called cassette inserts), with or without their toner supply systems for the satellite printing mechanisms of the machine, which can be displaced from their working position into a service position, towards the operation or drive sides. This permits easy and fast adjustment to changed printing conditions, e.g. new toner containers, illustrating cylinders or cleaning systems, despite dense sequential arrangement of the satellite printing mechanisms and conditioning systems, wherein good accessibility facilitates the work to be carried out. Only with this construction, can more than four printing mechanisms be received in one satellite arrangement. Adjustments of the cassette systems or printing mechanisms in the service position are also possible during running production.

Essential to the design of the satellite printing machine is that it is suited for simple combination with a displaceable, inline further processing station. Servomotors are preferably combined with conventional gearing in this fashion, wherein the displaceability of the finishing units is a requirement. An advantage of this processing consolidation is the increased accuracy of the finished products and reduction of additional processing means.

There are conventional digital printing machines whose flexible use is optimized through extension of the machine configuration with several paper feeder devices and sheet trays but which require a relatively large amount of space (large foot print) due to their horizontal arrangement and which require several feeder and delivery devices.

One machine concept is novel and considerably easier and compact, with which the so-called sheet trays are vertically arranged for only one single feeder and only one single delivery, with minimum machine floor space (foot print).

In a further inventive embodiment (FIG. 8), the gripper transport device can be mechanically lowered into the cylinder to below the cylinder surface when it is not used for the sheet transport such that the illustrating cylinders can unwrap irrespective of the format without gripper openings or tensioning channels, or without upward/downward motion.

Also novel in sheet processing as offset rotation printing, is the innovative arrangement of the gripper shaft which permits lowering (FIGS. 10 and 11) and also pivoting to facilitate exchange of tensioned printing blankets (FIG. 12).

The gripper systems could be designed such that they can be pneumatically or electromagnetically lowered. The lowering mechanism of the grippers can also serve for adjustment to the variable thickness of the material to be printed.

In a further inventive embodiment, the satellite printing machine is constructed such that at least the intermediate supports 2*a*+2*b* have a periphery of the smallest common denominator of several standard formats e.g. B3, B2, and B1 to facilitate mass production. These cylinder heads are very advantageous for mass production but more importantly provide a standard imaging cassette which can be mass produced at little cost.

The patent document U.S. 2002/00980017 shows the use of digital printing mechanisms for front and back side printing of different constructions. A further inventive embodiment is the uniform construction of the imaging cassettes for both front and back side printing in that they or the machine is/are prepared in terms of construction e.g. drive, tube connection etc. for mounting, from the drive side and also from the operating side to permit uniform construction also for both front as well as back side printing.

In the satellite printing machine, the printing mechanisms for front and back side printing can be sequentially disposed with or without surface drying. Moreover, one complete printing unit is installed per (process) color and therefore, the color copies are printed in the so-called SINGLE SHOT and SINGLE PASS SYSTEM in front and back side printing. At the input and/or output of the counterpressure cylinders, several variants and additional steps can be integrated before and/or after digital printing e.g. in the cassette units 9 and 15 (FIG. 3) e.g. for conditioning, coating, lacquer application, special print, fixing (fusing), drying and subsequent moistening. In accordance with the invention, a uniform system 21 is integrated for combined application of protective lacquer and silicon oil for fixing (fusing). The counterpressure cylinders 4 have a surface which rejects color or toner. One single feeder 6 and one single delivery 18 can exchange various material to be printed in the paper pile in an easy and non-stop fashion using paper cassettes, so-called sheet trays. For optimum operating ease, the printing and conditioning systems are disposed in the cassette inserts. This provides optimum accessibility to the working position 54 within the machine frame and in the service position outside the machine frame, on the operating 55 and/or drive side 56.

The printing quality of digital printing and of conventional printing techniques requires clean surfaces of the intermediate cylinders coated with an elastic material. The intermediate cylinder is exposed to surface soiling through a mixture of i.a. paper dust and toner residues. The use of 2-fold cleaning systems is novel.

1. A system e.g. with electrostatic brushes which rotates against the direction of rotation of the intermediate cylinders to remove the toner residues.
2. A cleaning system with brushes or blanket, which are enriched with water for removing the paper dust residues.

A further inventive embodiment is a photo conductor drum/illustrating cylinder with bearer rings. Due to the gripper-receiving recess on the periphery of the intermediate cylinder, optionally having tensioning channels, the rotating printing process generates irregular pressure load which can produce stripes in the print. Mounting of the bearer rings on the photo conductor drum and the intermediate cylinder, which are mounted with pretension, eliminates this irregular pressure load and obtains optimum printing quality. The illustrating cylinders, which are constructed for rapid exchange, can be coated as a photo conductor drum. However, they are preferably designed for one-side quick dismounting of the bearer rings to facilitate replacement of the photo conductor sleeve. A further inventive embodiment of the digital printing mechanism is a construction which permits rapid exchange of the toner unit 53, including its color-carrying components. One particularly advantageous effect of this innovative printing machine and method is the particularly low energy consumption, which is estimated to be only approximately 20% of the consumption of the conventional printing machines with drives for 35 meters of length, intermediate and end dryers, and temperature-control systems for the printing mechanisms.

A further aspect of the invention is the integration of a corona treating system in the machine to permit use of plastic materials and/or metallized and/or sandwich materials without pre-treatment. Prior art does not permit integration in the sheet printing machine due to limited space conditions in sheet transfer systems through arrangement of staggered feeder, front lay mark and pivoting gripper.

A dryer 11 is provided on the delivery side. Further transfer drums (not shown) can be inserted between the two counterpressure cylinders. A chain transfer (not shown) could be inserted between the two counterpressure cylinders e.g. for intermediate cooling.

The presented arrangement with up to approximately 10 printing mechanisms is to be considered as basic embodiment of this compact construction. If further printing mechanisms are required, individual posts with conventional and/or digital print could be placed upstream or with a multicolor frame. Possible inline finishing (production) may normalize the complete production of the finished products, which are e.g. punched, stamped, perforated, folded and cut.

The underlying purpose of the invention is achieved by a digital printing machine which comprises the features of claim 1.

Further details and advantageous effects of the invention can be extracted from the following description and the drawings which show embodiments of the inventive satellite printing machine.

DESCRIPTION OF THE PREFERRED EMBODIMENT

Figure 1:
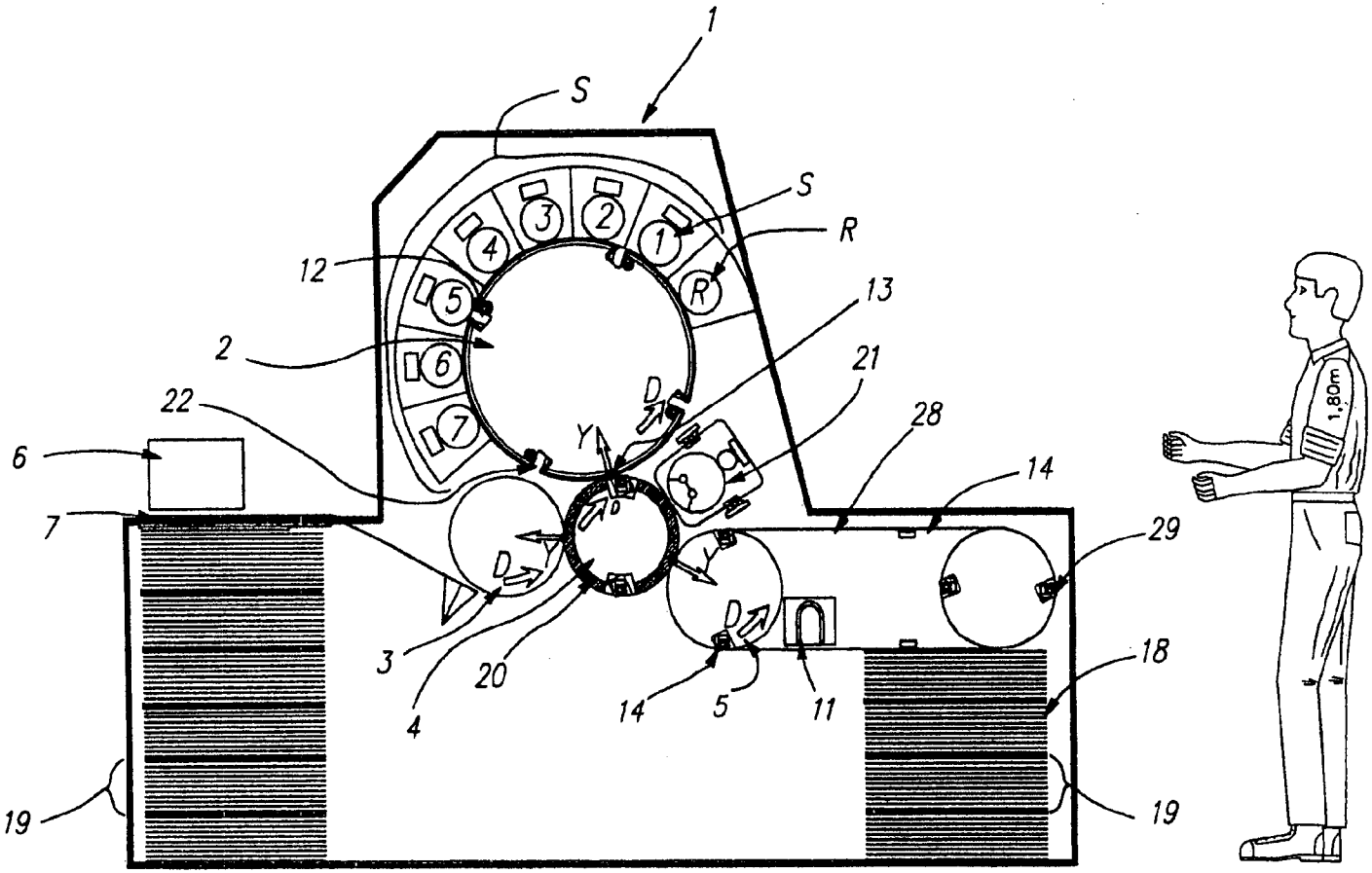
FIG. 1 shows a side view of the inventive satellite printing machine.

FIG. 1 shows a satellite printing machine, referred to with 1, with an apparently illogical combination of format-free printing mechanisms and formatted gripper transport systems, with a formatted intermediate cylinder 2 having rubber blankets and with a counterpressure cylinder 4 which, relative to the direction of rotation D, has an upstream cleaning system R and seven format-free satellite printing mechanisms S for multicoloured, front side printing, with one formatted sheet feeder 6 and a formatted delivery 18 both for the so-called sheet trays 19.

The printing sheets are transferred from the sheet feeder 6 to the first printing mechanism and optionally from printing mechanism to printing mechanism and from the last printing mechanism to the delivery pile 18 using gripper technology which is integrated in a format-dependent manner in the counterpressure cylinder channel or in a chain carrier. The separation between two adjacent gripper systems is therefore always equal to the maximum printing format in the peripheral direction.

A cassette unit 21 is also shown for the combined application of silicon oil and protective lacquer. The drawing clearly shows that the illustrating cylinders 1 through 7, which are not restricted to a format, have a considerably smaller diameter than the format-dependent lacquer or silicon application cylinders 21. The 7 o'clock position is not shown herein.

The schematic illustration of the satellite printing machine 1 of FIG. 1 uses sheets as the printing material which can be grasped in the region of the supply cylinder 3, wherein the counterpressure cylinder 4 and the delivery system 5 have gripper systems 14. The supply cylinder 3 has an upstream alignment table 7 which can be adjusted in the transverse direction, in height, in the supply direction and/or in an inclined direction relative to the supply direction through conventional side and front lay mark systems. It is also feasible to provide adjustment means on the alignment table 7 (not shown in detail) for carrying out the above-described changes in the supply direction of the printing material. These adjustments can also be made during operation of the satellite printing machine 1. The alignment table has vacuum transport bands and in these regions, the table has respective format-dependent shieldings to prevent energy loss (not shown).

The machine 1 is designed such that the supply cylinders 3, pressure cylinders 4, intermediate cylinders 2, illustrating cylinders 52 (including toner unit 53) and delivery cylinders 5 can be radially displaced via eccentric bushings (arrow Y) for adjustment, during production, to different thicknesses of the material to be printed. Linear adjustment is also feasible.

In an embodiment which is advantageous for operation of the machine 1, the supply system 3 and the delivery system 5 are disposed above a support plane at substantially the same height to define an approximately horizontal operation plane. Additional units for inline finishing or further processing may be provided in the region of the delivery system 5 and/or delivery chain 28 for further downstream processing (FIG. 3) using further guidance of printing material in a supply line for lacquering, drying, embossing, punching and the like. These heights permit simple loading and unloading of the machine 1 from the floor.

The machine 1 is realized in such a manner that any printing methods can be combined to maximally utilize the flexibility of the material to be printed.

Figure 2:
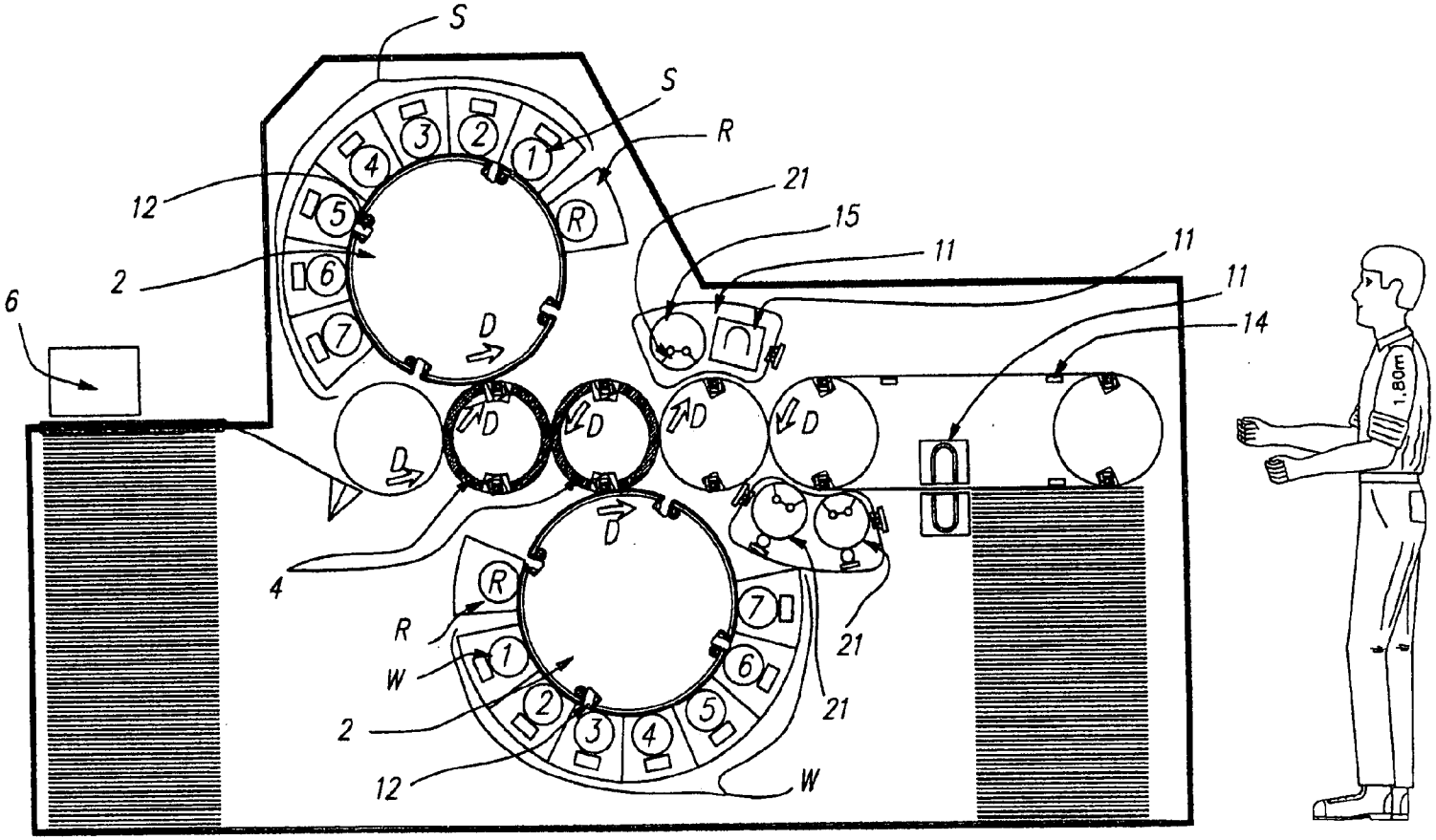
FIG. 2 shows a side view of the inventive satellite printing machine with upper and lower intermediate cylinders.

FIG. 2 is like FIG. 1 however having a second intermediate cylinder 2*b* and counterpressure cylinder 4*b*, and also 2 cassette units 15 e.g. for finishing.

Figure 3:
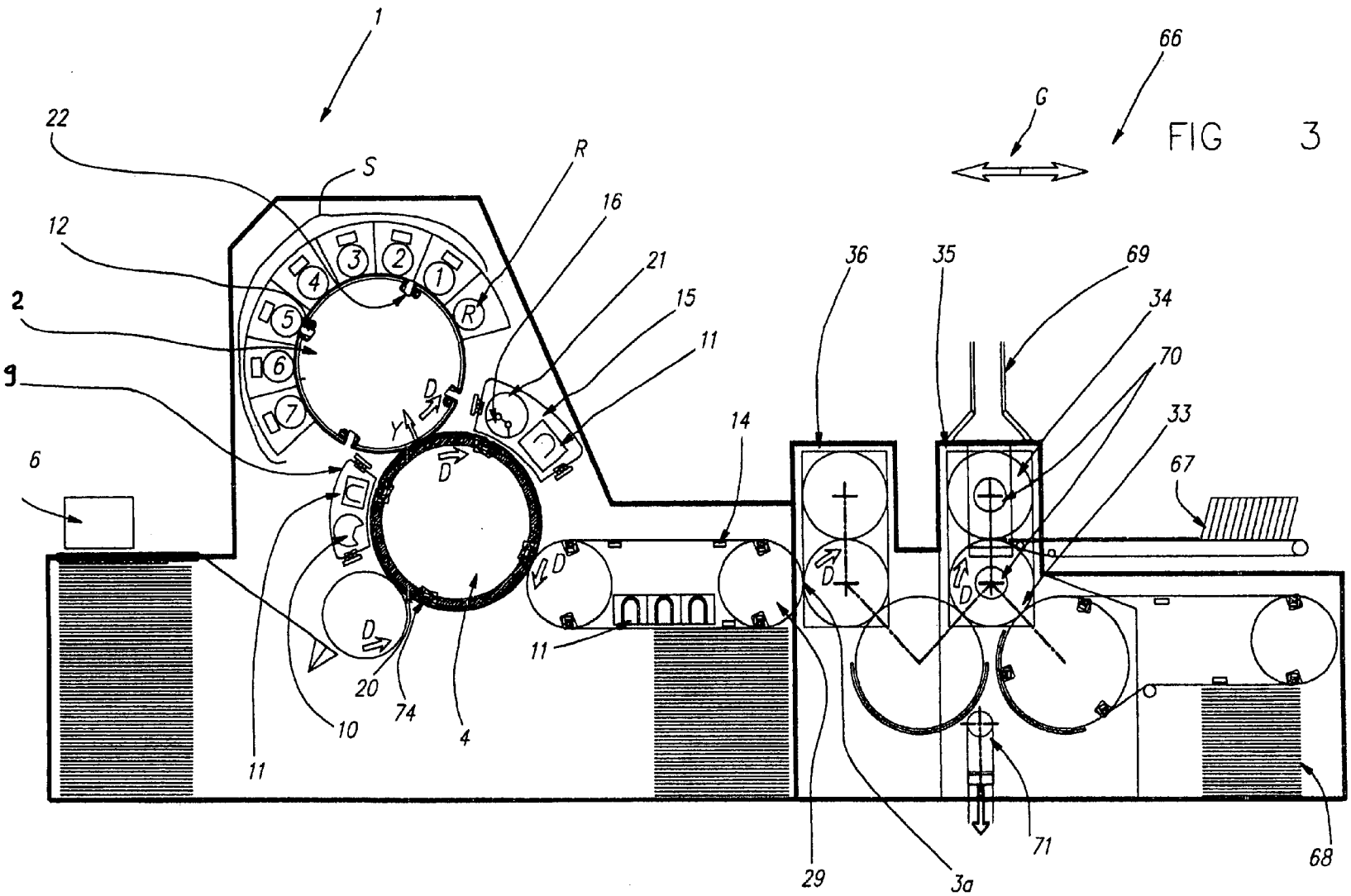
FIG. 3 shows a side view with enlarged counterpressure cylinder with associated pre-press and finishing cassette and inline further processing system.

FIG. 3 is like FIG. 1, however, with enlarged counterpressure cylinder 4 for disposing cassette units for pre-press systems 9 and cassette units for finishing systems 15.

The displaceable (arrow 6) inline further processing unit 66 is also shown. The figure clearly shows that the substrate sheet is completely printed before it is taken over by the delivery chain.

FIG. 3 also shows a device for finishing works, in particular for cutting or punching 35 and/or embossing and foil application 36 via a rotation process, wherein the material to be printed 57 can be inserted in an advance direction D between two rotating processing rollers 33, 34 and is processed while passing tool parts (not shown) acting in the working gap, to separate the substrate into a waste part and a useful part.

The suction hood 69 disposes of the waste part in an upward direction. Disposal may also be effected via the inside of cylinder 70 or in a downward direction 71.

The delivery 67 may deliver finished products such as folding box blanks or finely cut-out sheets. The delivery 68 can deliver punched sheets or sheets with sections.

Figure 4:
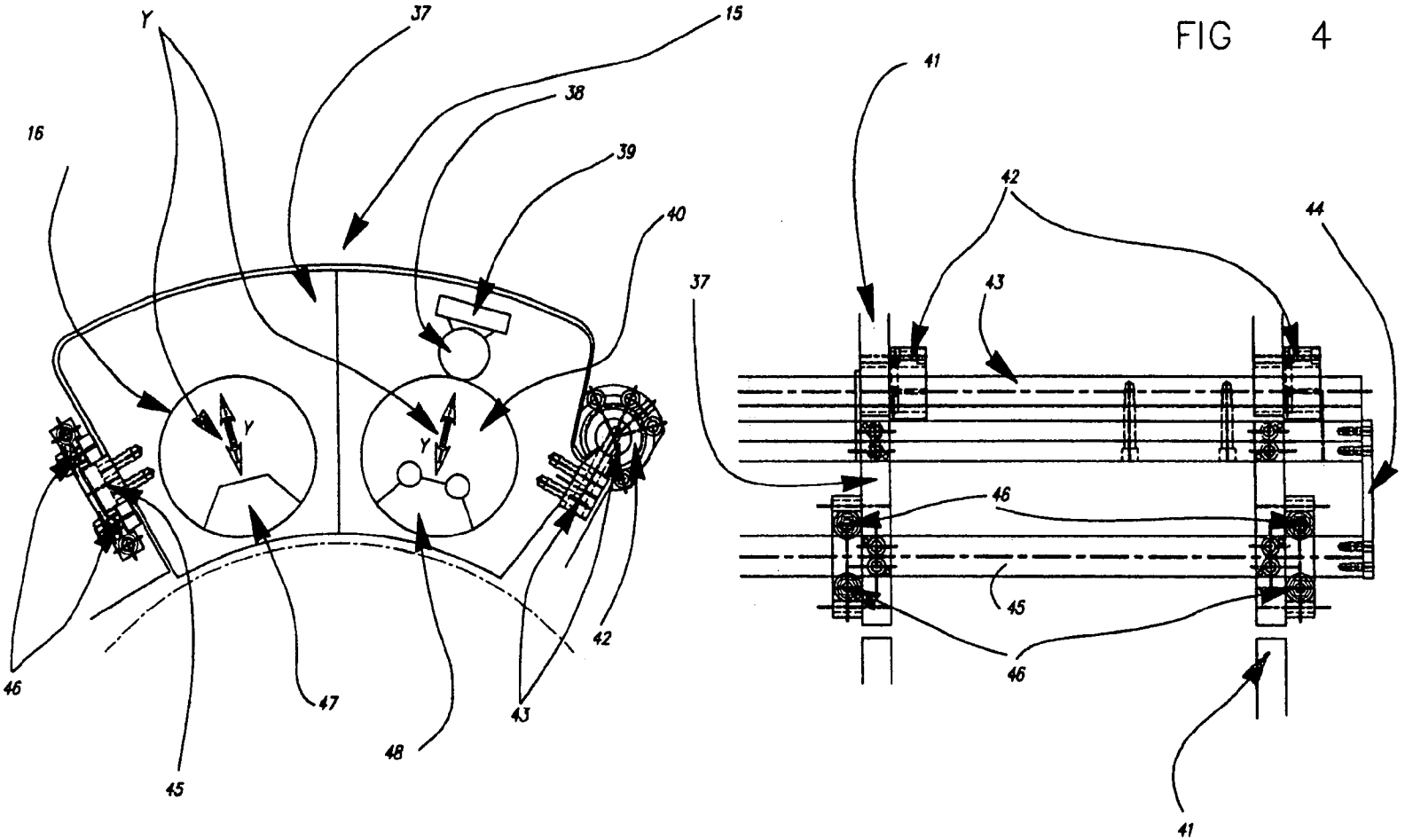
FIG. 4 shows an enlarged sectional view of a cassette system for conditioning.

FIG. 4 shows the support of one cassette unit for finishing 15 in the region of the machine frame. The cassette unit is thereby supported on rails 43 and 45 of respective side posts of the machine frame 41. The cassette unit 15 can be displaced in a parallel manner on these rails. It is also feasible to displace each satellite printing mechanism 5 together with these rails. In the embodiment shown, a linear ball bearing 41 or cam rollers 46 are provided for the respective rails (FIG. 2) and the rail 43 has a lower traverse. For positionally accurate displacement of the cylinders, the two rails are connected via a support brace (44) such that they can be displaced next to the machine frame and can be returned into the working position without any distortion.

The anilox roller 38 is also referred to as a screen or nap roller since it has a screen of laser-produced nap which absorbs more or less liquid in dependence on its size. The upstream chamber doctor 39 controls the coated film and regulates the return motion. The anilox roller 38 can be quickly exchanged to permit coatings of different thicknesses. This also applies for standard anilox rollers and also to photo conductor anilox rollers.

Figure 5:
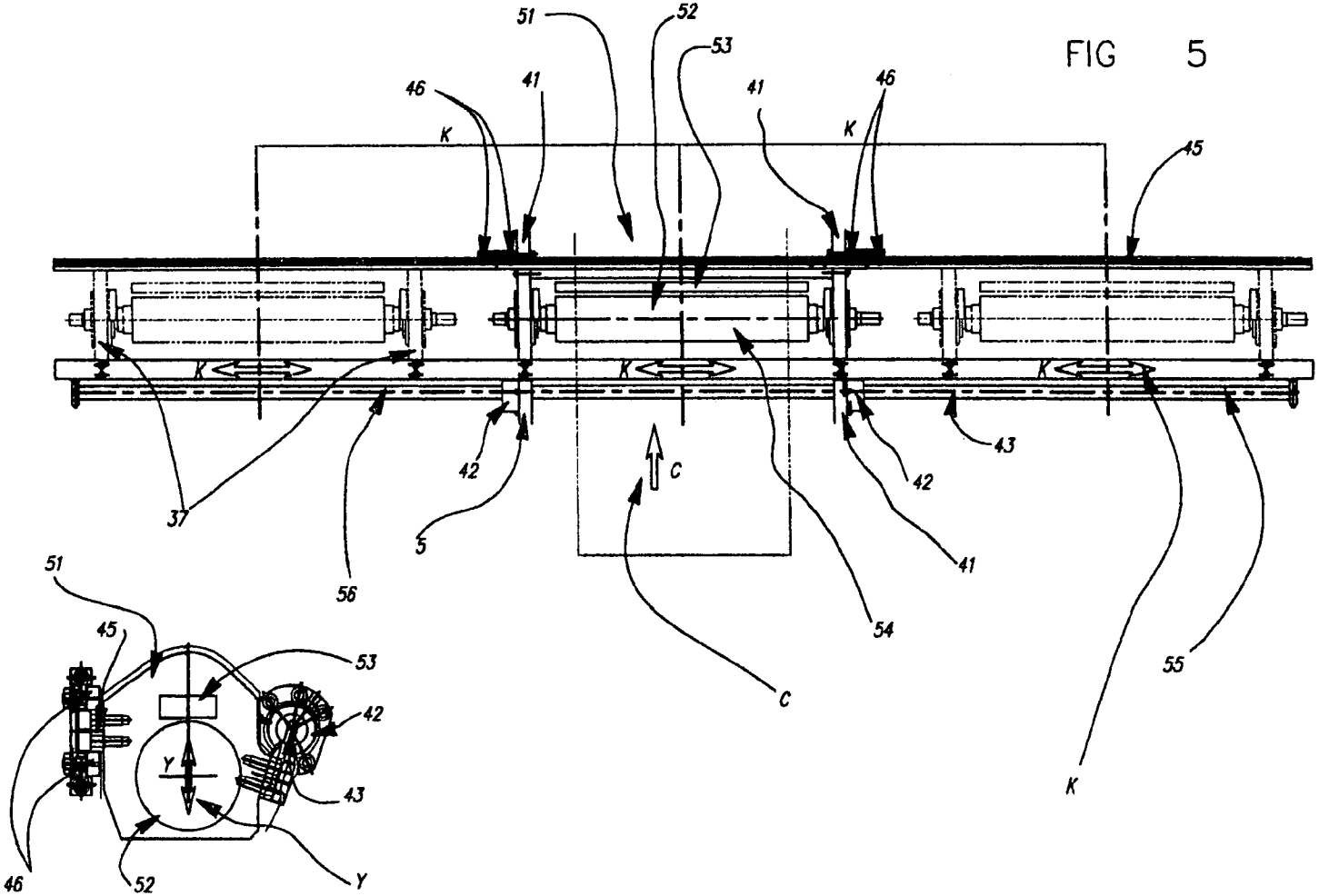
FIG. 5 shows a representation of one cassette system for illustration in different working positions.

The illustrated cassette units 51 of FIG. 5 each comprise an illustrating cylinder 52 and a (replaceable) toner supply unit 53. After lifting (Y) from their printing position (FIG. 4 and 5) on the intermediate cylinder 2, the cylinders in the cassette units 15 can be displaced into a service position without requiring tilting of the cassette unit. This increases the position stability of the cassette units which permits printing with little vibration to eliminate printing distortions.

FIG. 5 also shows the cassette positions in the machine frame, referred to in general with 41, wherein the cassette unit 51 is shown in the medium region, i.e. working position 54 and the right-hand side of the illustration shows that the cassette unit can be displaced parallel to the axis of rotation of the intermediate cylinder 2 into a lateral service position toward the operator side 55, next to the machine frame (arrow K, FIG. 5). The cassettes are also shown in a service position at the drive side 56.

The inventive cassette concept of the satellite printing machine 1 permits up to ten associated satellite printing mechanisms for front side printing S and up to ten satellite printing mechanisms for the back side W which may be directly adjacent to each other, in compact construction.

The toner cassette 53 with color-carrying part is constructed to be replaced for convenient color change, e.g. for customer-specific colors.

The photo conductor drum or illustrating cylinder 52 are also constructed for quick exchange.

Figure 6:
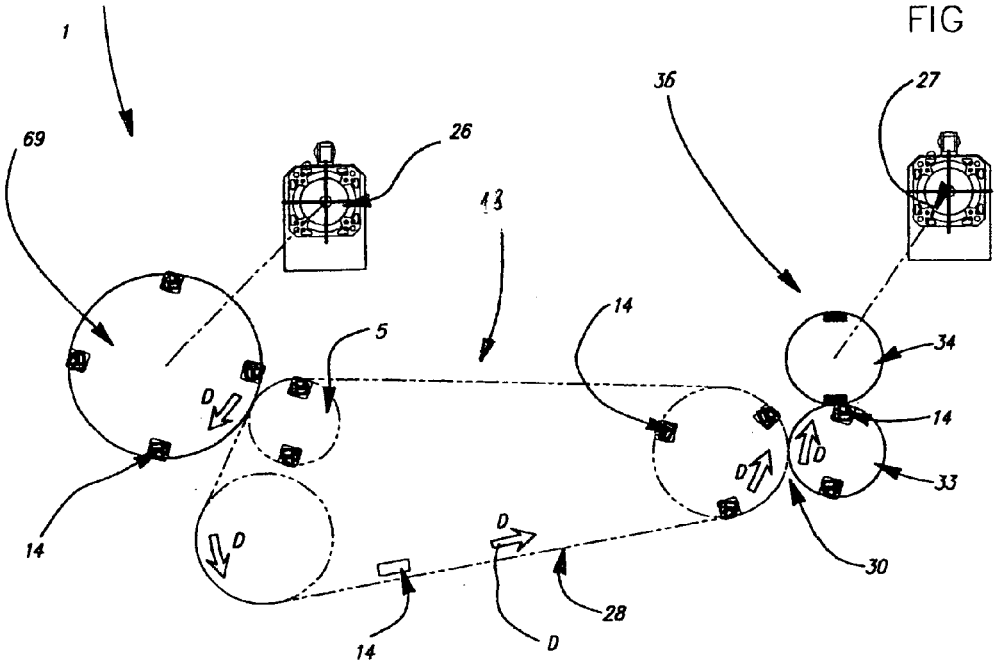
FIGS. 6 and 7 each show a schematic illustration of the inventive satellite printing machine with a drive concept in the region of the sheet delivery.
Figure 7:
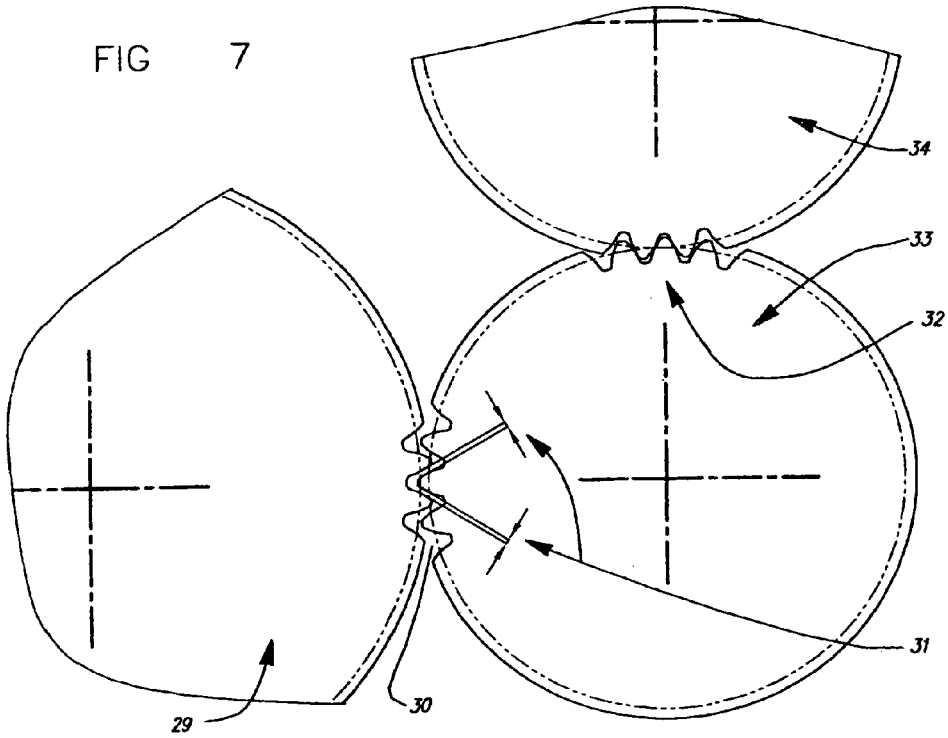

FIGS. 6 and 7 show a schematic illustration of a drive concept in the region of the printing machine 1, the delivery system 18 and the device 36. Two servo drive motors 26 and 27 are provided for securing a synchronous drive, each with a contact-free gearing 30, wherein the gearings also engage without contact at a constant separation 31 during the drive phase. The teeth abut only when a control error, e.g. a software error, could produce an undesired overload of the system, requiring immediate switching off of the drive moment. This gearing 30 protects the system from damage, in particular the gripper systems, in a straightforward manner. The play-free gearing 32 provides synchronous motion of the male mold punching cylinder 34 and female mold punching cylinder 33.

Figure 8:
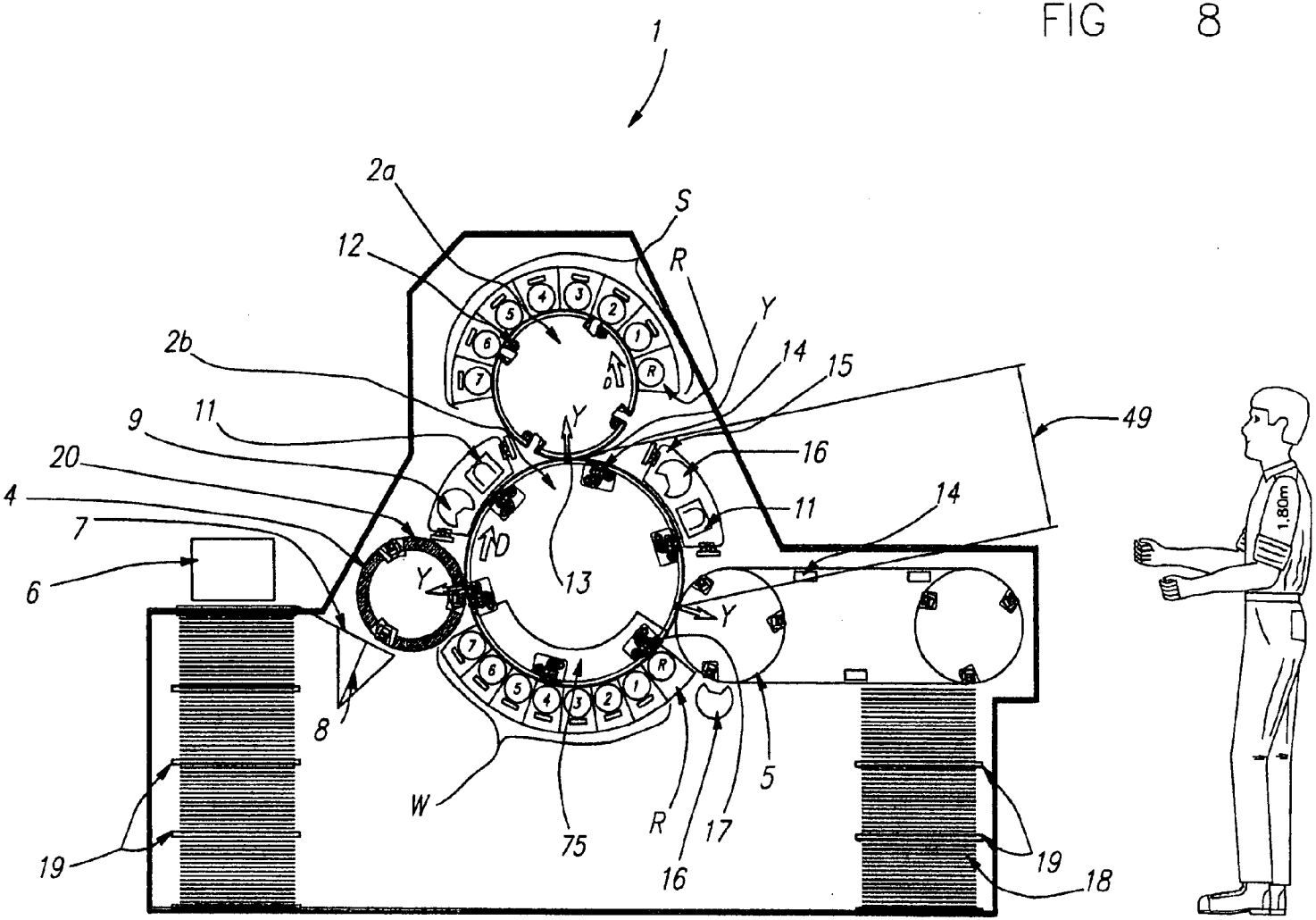
FIG. 8 shows a side view with intermediate cylinder with gripper system, shown in the 7 o'clock position.

FIG. 8 shows the satellite printing machine of FIG. 1, in an inventive embodiment having an additional lower intermediate cylinder 2*b* comprising rubber blankets, with an associated cleaning cylinder 6 and seven satellite printing mechanisms W for multi-color reprinting, viewed in the direction of rotation D, behind the delivery system 5 and before the supply cylinder 3. The intermediate cylinders have different circumferences, e.g. for receiving conditioning cassettes.

A pre-print cassette 9 is disposed before the printing point 13 of the two intermediate cylinders e.g. for fixing or conditioning and a cassette 15 is disposed after the printing point 13 e.g. for finishing (e.g. application of lacquer). In the above-described arrangement of FIG. 8, the back side print is effected in the region between the supply cylinder 3 and the contact point or printing point 13. The grippers are lowered in the region 75.

FIGS. 9, 10, 11, 12, and 13 show a section with gripper systems illustrating the gripper support 64, material to be printed 57, tensioned rubber blanket 58, cylinder body 59, tensioning strip 60 and glued rubber blanket 65. A rubber blanket tensioning system 90 with tensioning strip 60, tensioning slit 62 and tensioning direction 63 and gripper back 61 are also shown.

Figure 9:
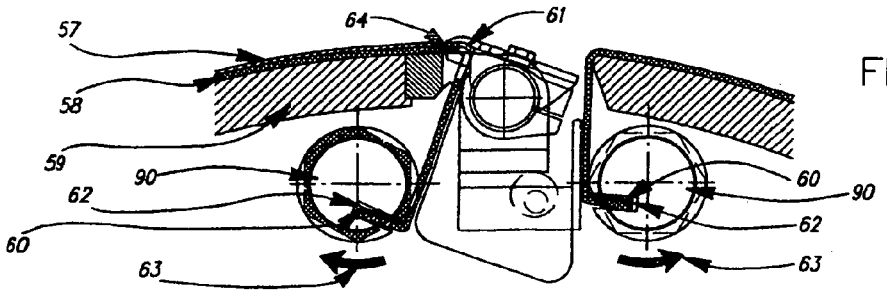
FIGS. 9 through 13 show sectional views of the intermediate cylinders in the region of the gripper transport system.

FIG. 9 shows the gripper system in its working position for substrate transport 57 with tensioned printing blankets 58, wherein the rubber blanket is tensioned with two tensioning shafts 90.

Figure 10:
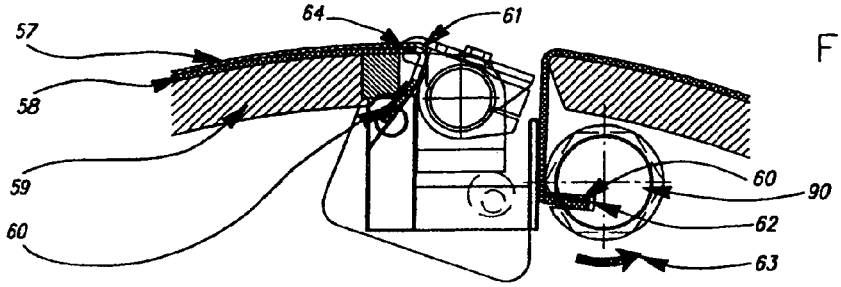

FIG. 10 corresponds to FIG. 9, however, the rubber blanket is clamped with the tensioning strip 60 and tensioned with the clamping device 90.

Figure 11:
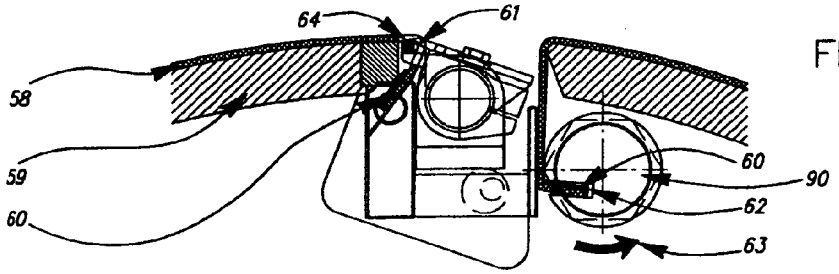

FIG. 11 shows the gripper system in a lowered position for passage of the illustrating cylinders. The gripper backs 61 are now below the unwinding surface, whereby the illustrating cylinders can be unwound under pressure without gripper openings or gripper channels on the elastic printing blanket without any risk of damage.

Figure 12:
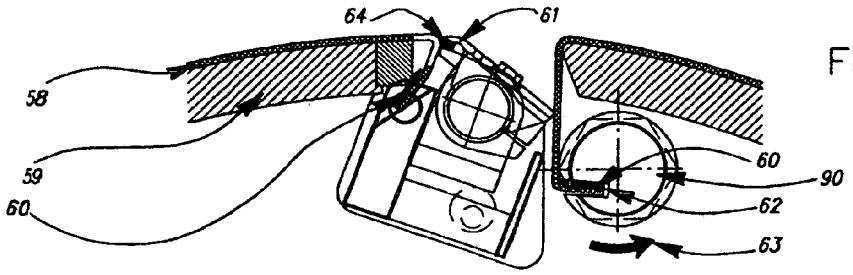

FIG. 12 shows the gripper system in the pivoted-down position to enable exchange of the tensioned printing blankets 58.

Figure 13:
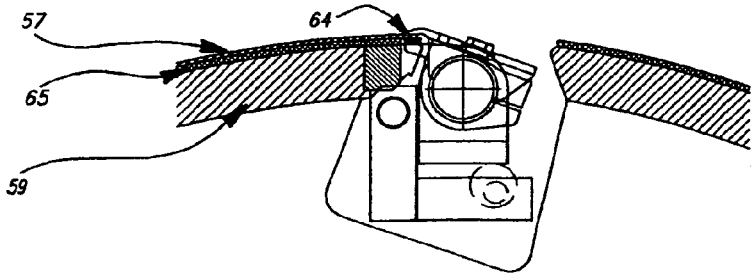

FIG. 13 shows the gripper system in connection with glued printing blankets 65 which conventionally require no tensioning device.

The gripper openings towards the gripper supports 64 in the printing blankets permit function of the gripper systems when the printing blankets are tensioned (not shown).

Tensioning strips 60 and tensioning slits 62 or tensioning shafts 90 with tensioning channels facilitate support for tensioning or re-tensioning of the printing blanket.

Figure 14:
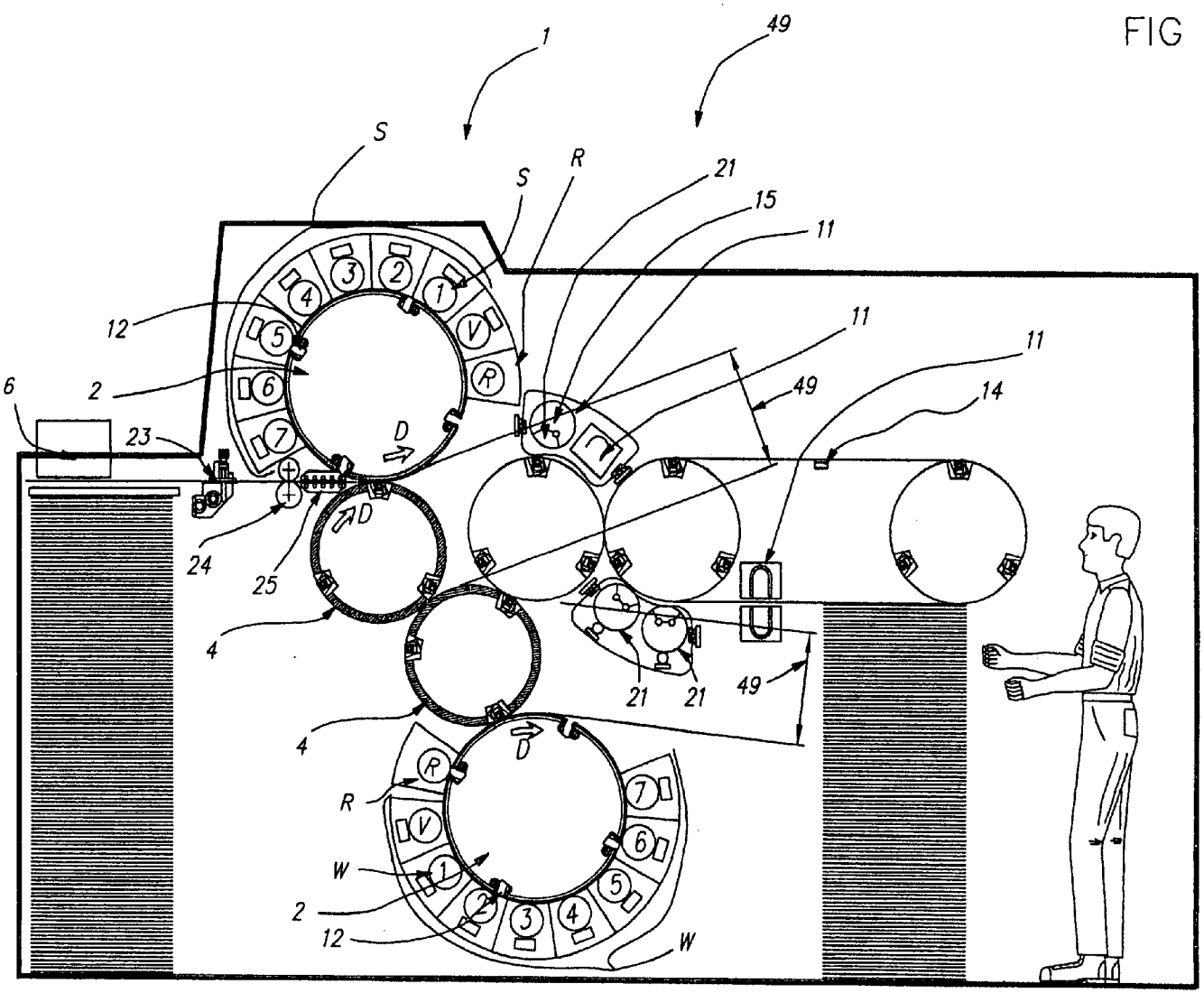
FIG. 14 shows a side view of the inventive satellite printing machine of FIG. 2, however, with horizontal feed advance system with integrated double chamber for corona treatment on both sides of the substrate.

FIG. 14 shows a satellite printing machine, referred to in total with 1, basically like FIG. 2 which shows horizontal sheet insertion with side mark 23 and advance roller 24 and double chamber 25 for surface finishing systems on one or both sides, e.g. for corona treatment. This chamber could be loaded with vacuum or compressed air to support and/or enhance the sheet guidance. The cylinder arrangement corresponds to the so-called 7 o'clock position.

Figure 15:
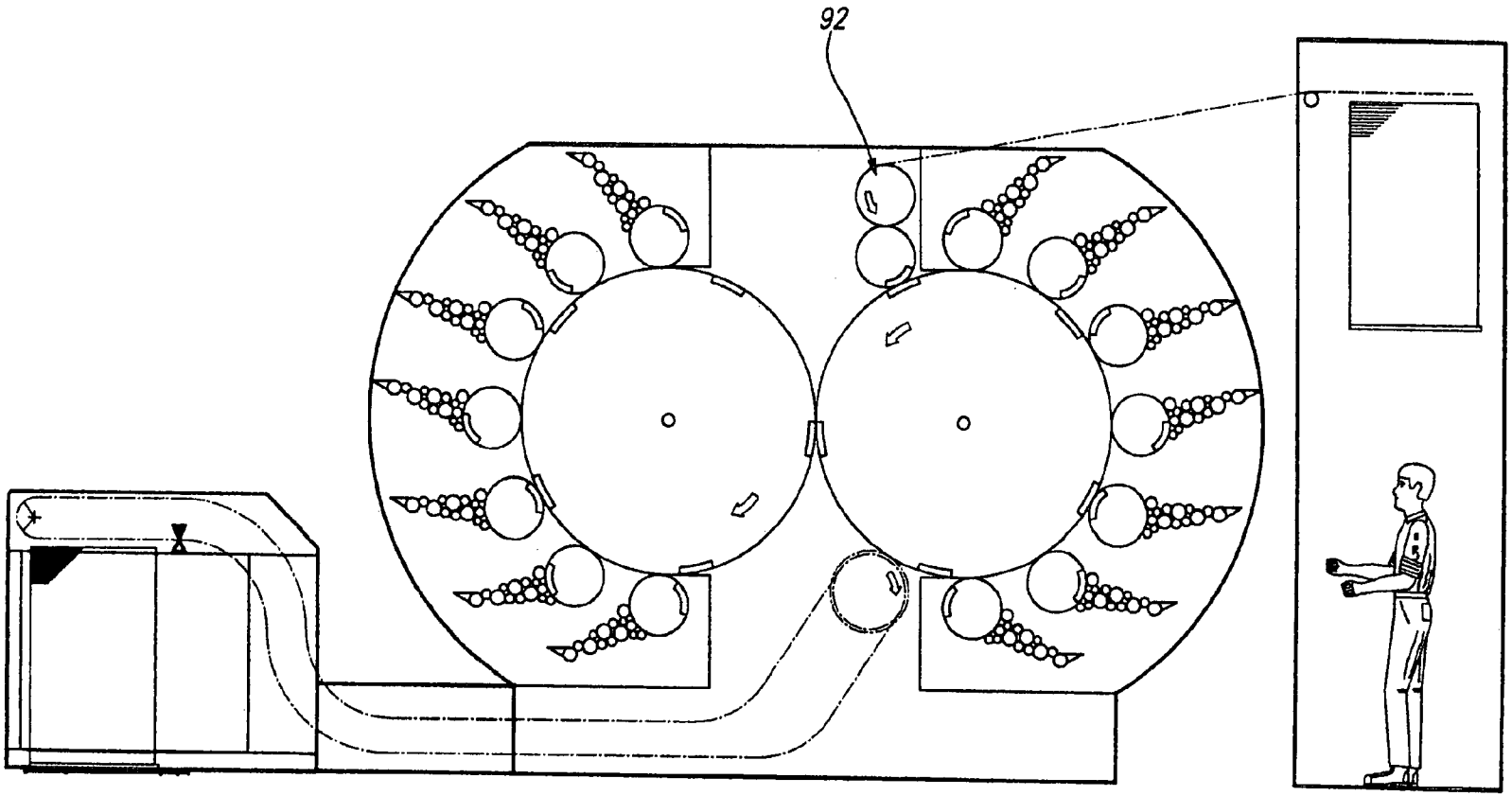
FIG. 15 shows a side view of an imaginary satellite-like sheet offset printing machine.

FIG. 15 shows a schematic printing machine of satellite construction based on FIG. 1 of U.S. Pat. No. 5,036,763. The schematic printing machine is extended to 2×7 printing mechanisms for Hi-Fi prints. The dimensions indicate that even the half-format (B2) of this machine would have unrealistic operating dimensions compared to FIG. 2. The so-called S-winding of the stop drum feed configuration 92 also fails to meet the requirements of minimum paper travel.

Figure 16:
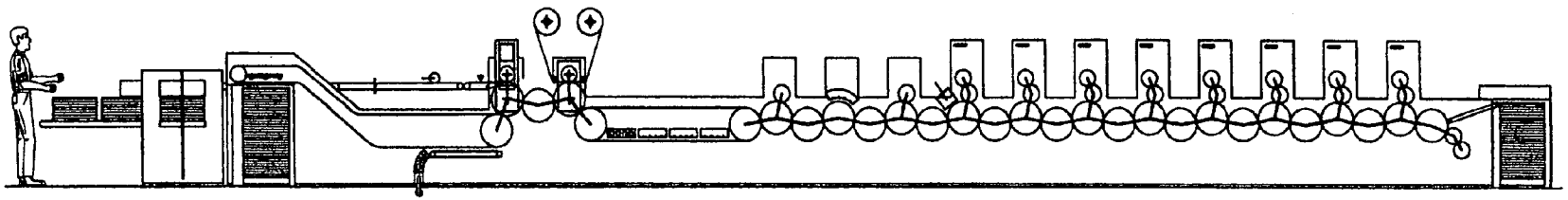
FIG. 16 shows a side view of an imaginary modular sheet offset printing machine with 8 printing mechanisms in series construction.

FIG. 16 also shows a schematic printing machine of modular, series construction. A schematic configuration like FIG. 2 with 2×7 colors and lacquer mechanisms and inline further processing would produce completely unrealistic dimensions and therefore non-economical investment for a printing machine.

Figure 17:
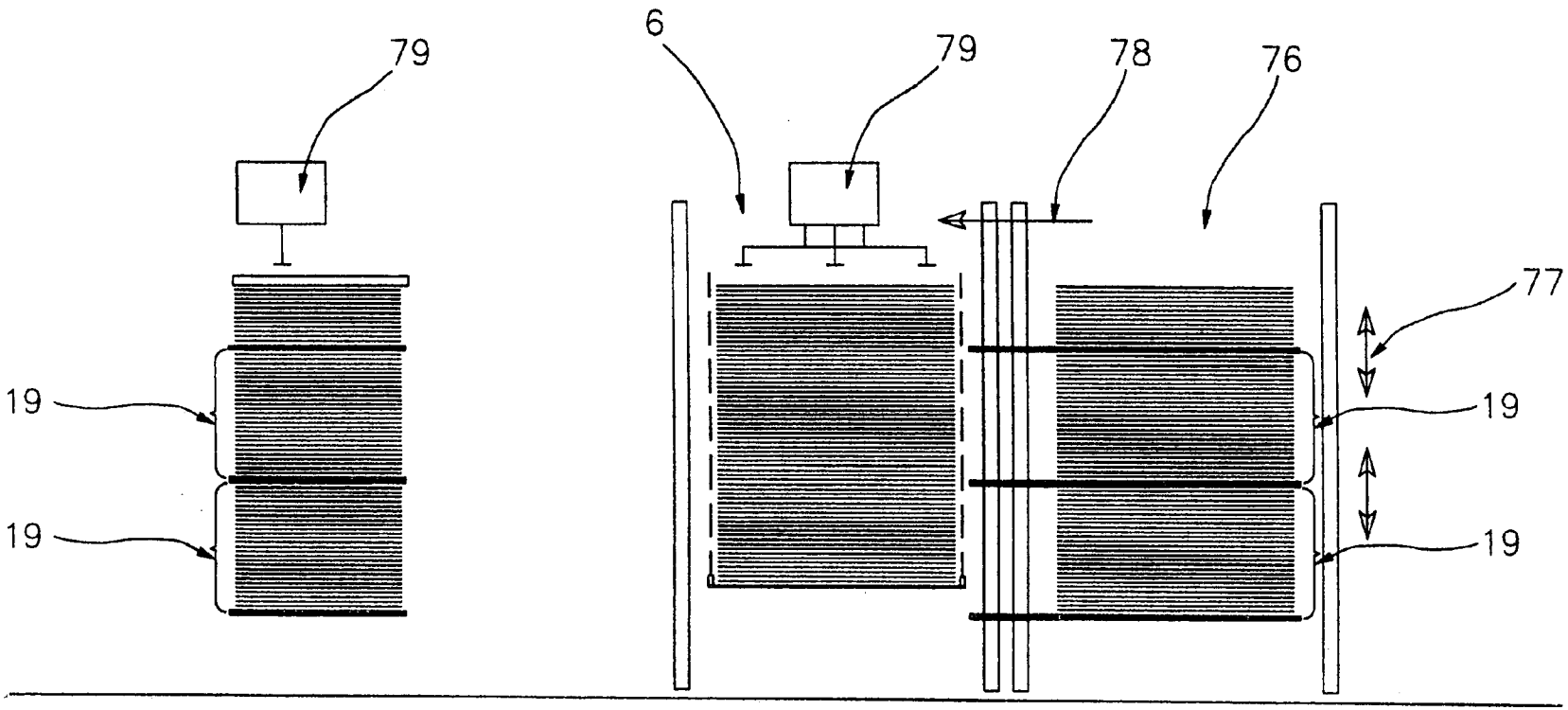
FIG. 17 shows a side view of the feeder with adjacent pre-piling means.

FIG. 17 shows a sheet feeder 6 with neighboring prestacking means 76. An operator can load one of the sheet trays (cassette with material to be printed) 19 during production, which can be adjusted to his/her height 77 and can then be positioned automatically by means of lateral displacement 78 in the feeder when the order changes. This permits rapid change requiring only one expensive suction head 79. One further advantage is that the length of the machine is not extended.

Figure 18:
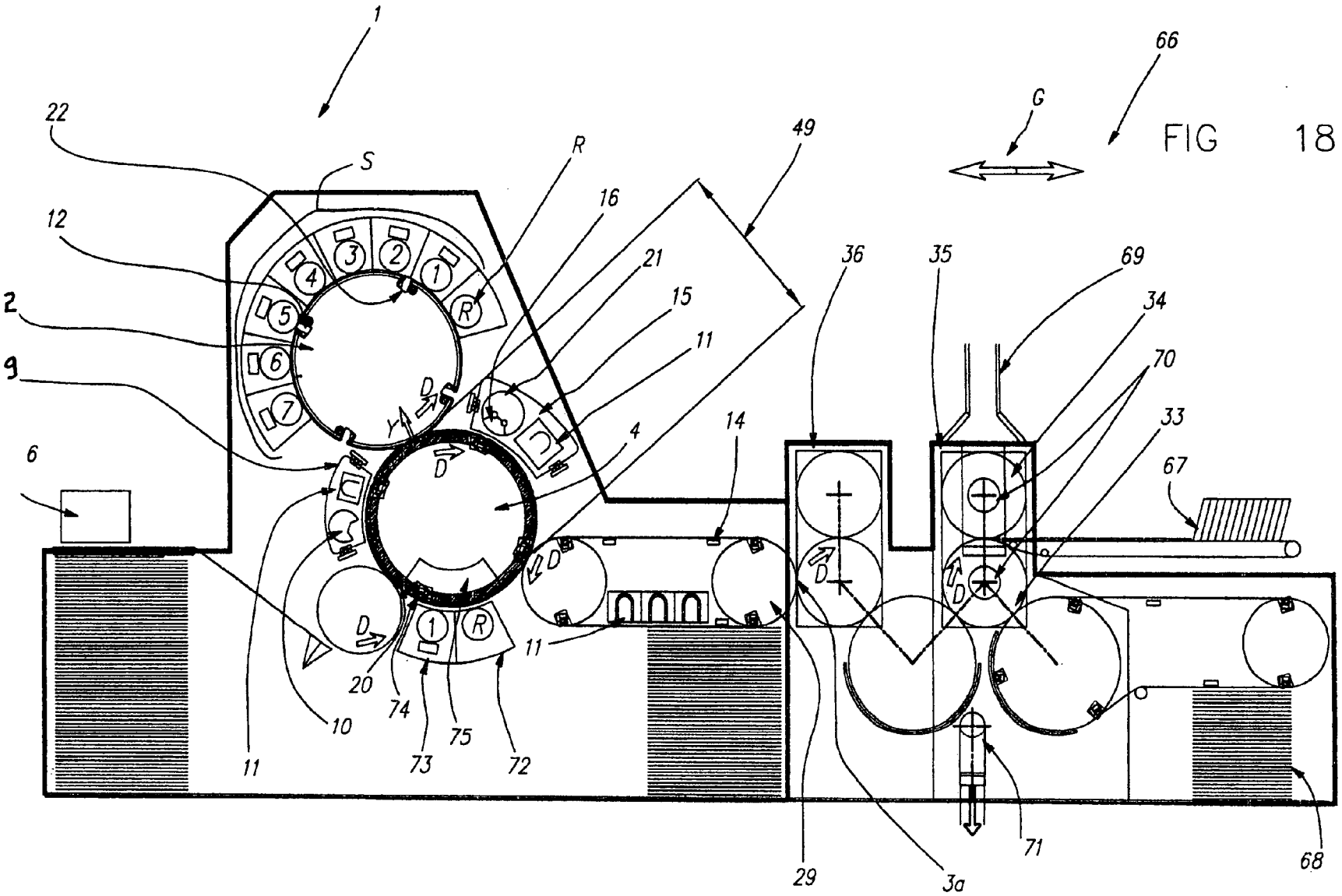
FIG. 18 shows a side view like FIG. 3, however, shown in the so-called 7 o'clock position, and reprinting system.

FIG. 18, similar to FIG. 3, also shows the so-called 7 o'clock arrangement 49, wherein the sheet is completely printed before it is further transferred by the delivery chain 14. The back side printing arrangement is also shown with one cleaning cassette 72 and one printing mechanism cassette 73. The counterpressure cylinder is coated with rubber blanket segments 74 and the grippers are withdrawn in the region 75.

Figure 19:
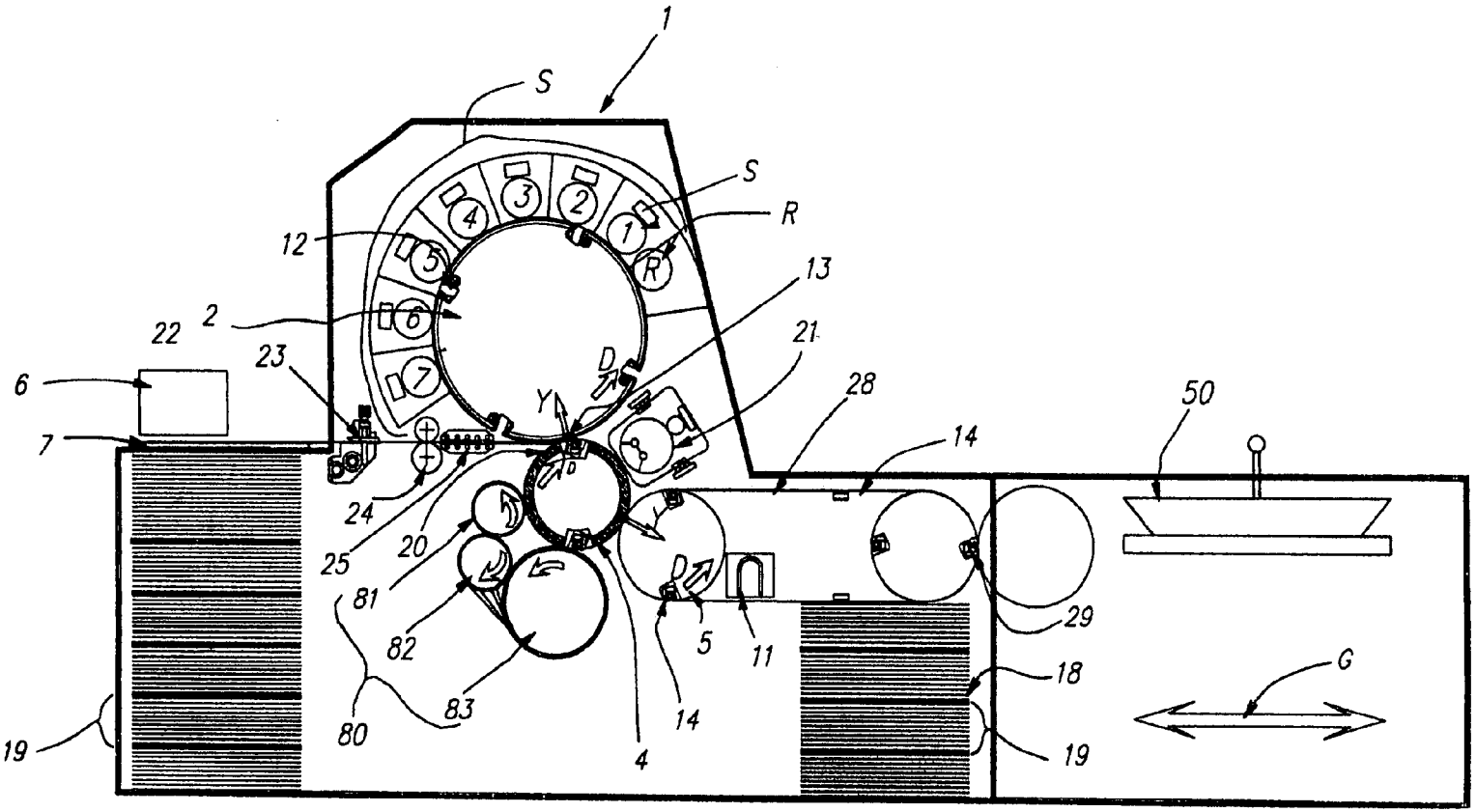
FIG. 19 shows a side view like FIG. 1, however, with advance system with integrated corona treatment system with integrated turning drum system and inline finishing unit.

FIG. 19 is like FIG. 1 with a conventional turning drum system with transfer drum 81, turning drum 82 and storage drum 83.

For a turning operation, the feeder is controlled such that no sheets are supplied when some sheets pass through the printing machine in a second run. The grippers in the counterpressure cylinder are program-controlled such that the sheets are automatically taken over by the delivery chain or not. This turning technology is prior art, however, in this embodiment the format is fixed. The fact that the transfer cylinder 81 is driven by a servo motor at different speeds permits processing of different formats in the peripheral direction.

An inline finishing unit 50 is also shown e.g. for folding or book-binding. The sheet is transferred precisely with gripper technology 29. Advantageously, this unit can be displaced.

Figure 20:
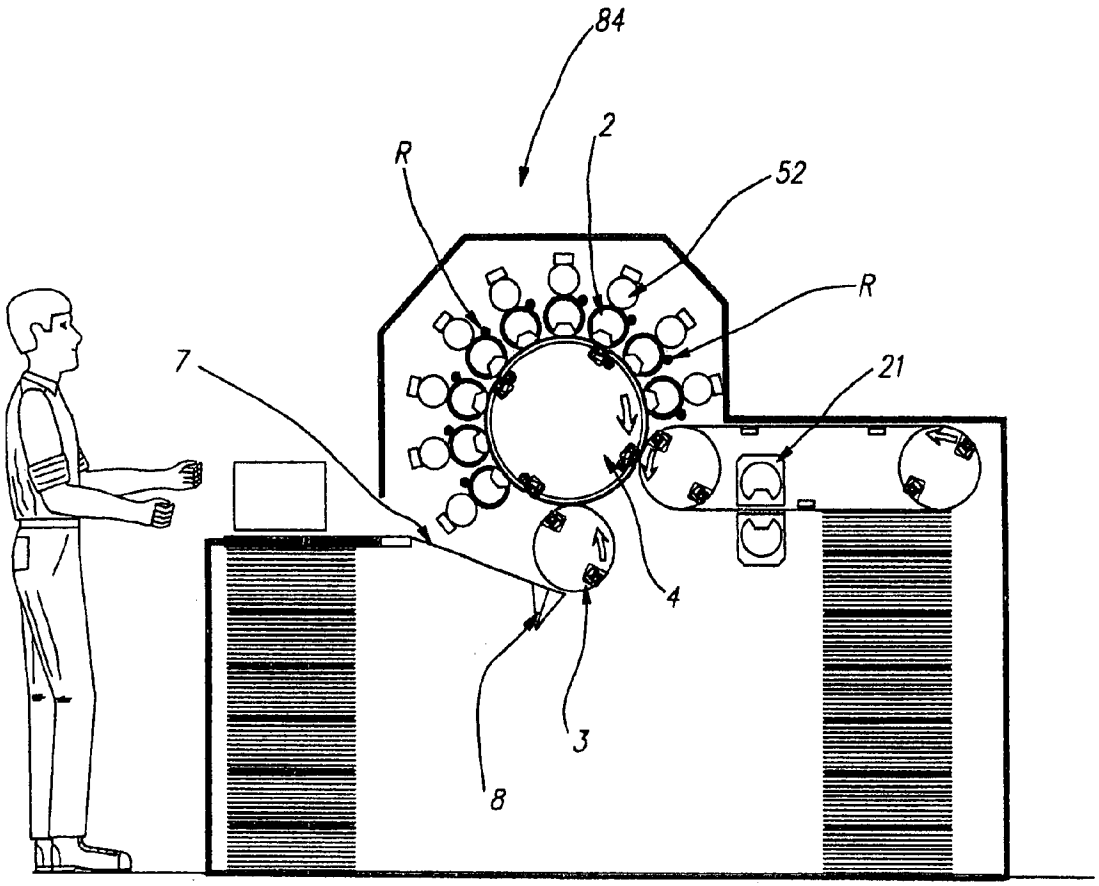
FIG. 20 shows a side view of a satellite printing machine with central counterpressure cylinder with gripper transport system and rubber blanket cylinder which is format-dependent and has channels.

FIG. 20 shows a satellite printing machine 84 with a central counter pressure cylinder and having gripper systems. The substrate sheet surrounds the counterpressure cylinder and is imaged with partial color in each digital printing mechanism, i.e. not in single shot. The illustrating cylinders or the photo conductor drums are smaller than the printing length and printing is effected indirectly via format-related rubber blanket cylinders, in this example of a diameter of only 129.36 mm or not even A3 upright format. The photo conductor-drum cannot print directly since it would be damaged by the projecting gripper backs of the grippers, which are mounted in the central counterpressure cylinder.

8 digital photo conductor drums are shown for e.g. a 7-color print with integrated lacquer application. The periphery of the format-related rubber blanket is 24.

Figure 21:
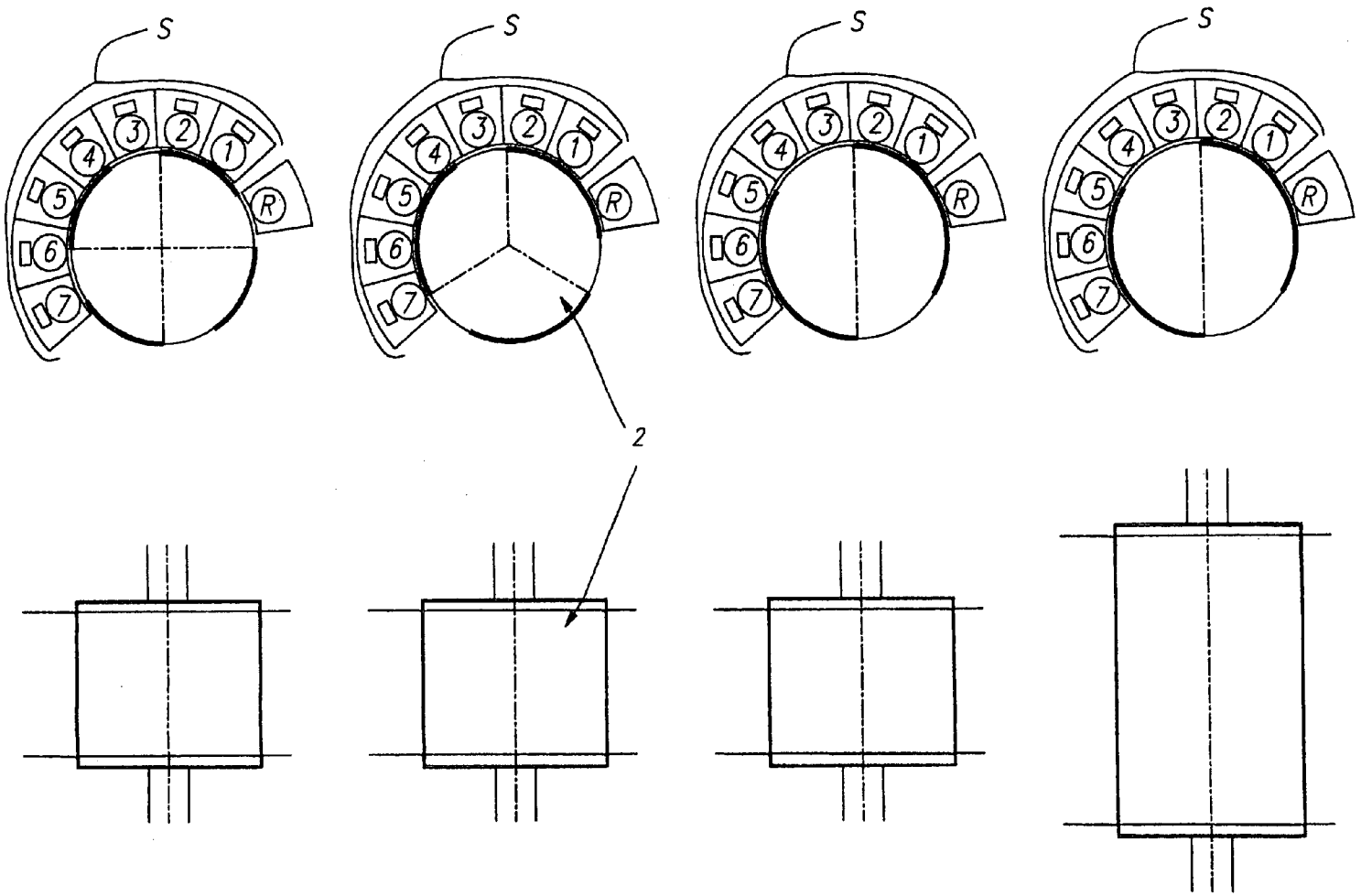
FIG. 21 shows a side view of the uniform intermediate cylinder for several standard formats.

FIG. 21 schematically shows an intermediate cylinder (2*a* and 2*b*) with a smallest common denominator of a diameter of e.g. 690 mm, which produces, with corresponding division by ¼ the B3 square format, by ½ the B2 portrait format, and by ½ but with double width the B1 landscape format.

This single periphery permits use of identical imaging cassettes which are disposed around the intermediate cylinder providing particularly inexpensive series production.

Figure 22:
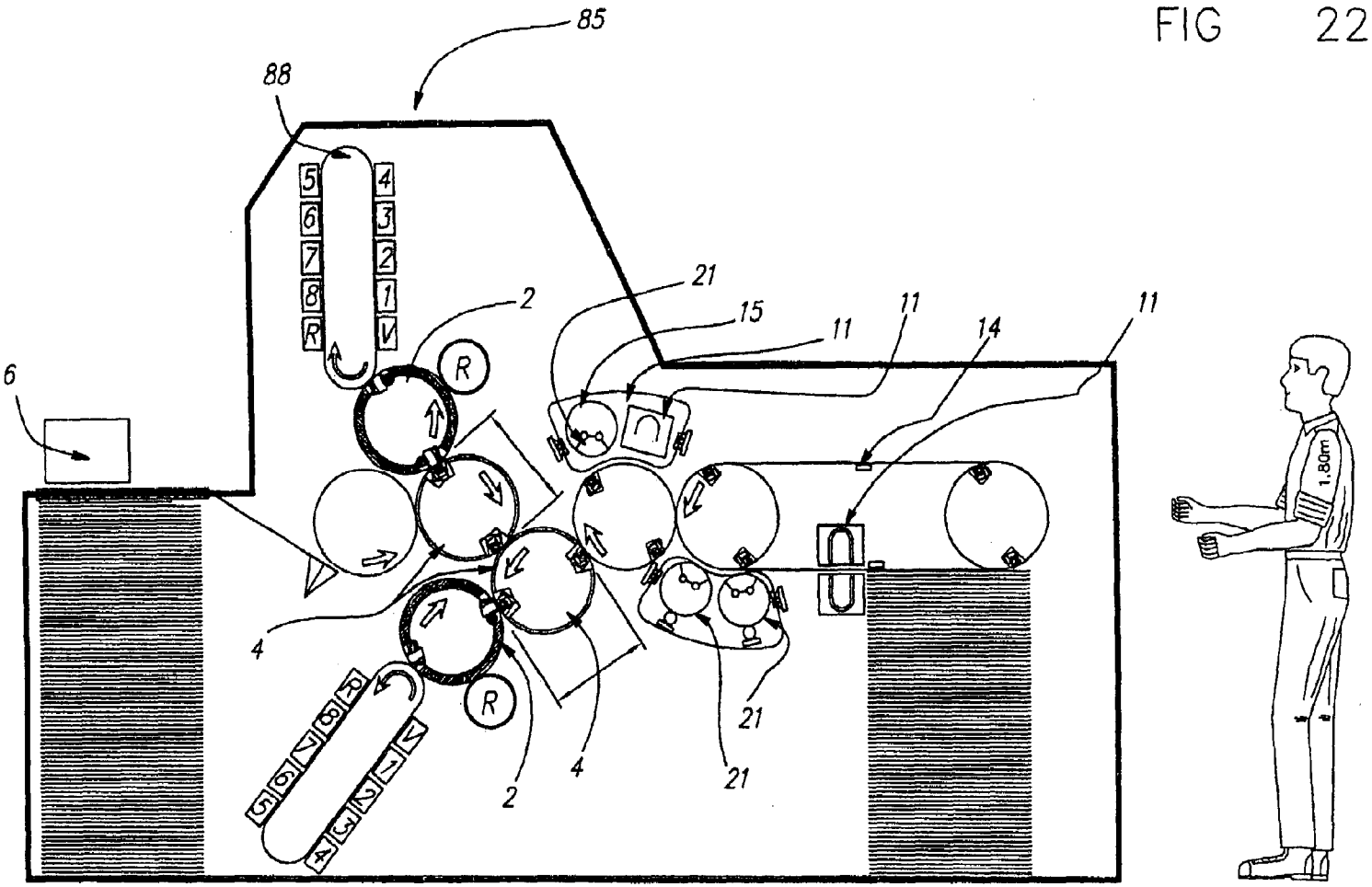
FIG. 22 shows a side view of a digital printing machine with transfer band.

FIG. 22 shows a digital printing machine 85 for duplex printing, wherein the intermediate cylinders provided with rubber blankets have an upstream transfer band 88 for accepting the individual colors.

Imaging of the transfer band 88 can be effected through contact, e.g. pressure or contact-free, e.g. through spraying or injection. The two intermediate cylinders 2 provided with rubber blanket/s including channels permit sheet transport by grippers since the grippers would otherwise damage the transfer band through direct contact due to the projecting gripper backs. The intermediate cylinders 2 are disposed such that transfer is effected when the printed image is completely printed.

Figure 23:
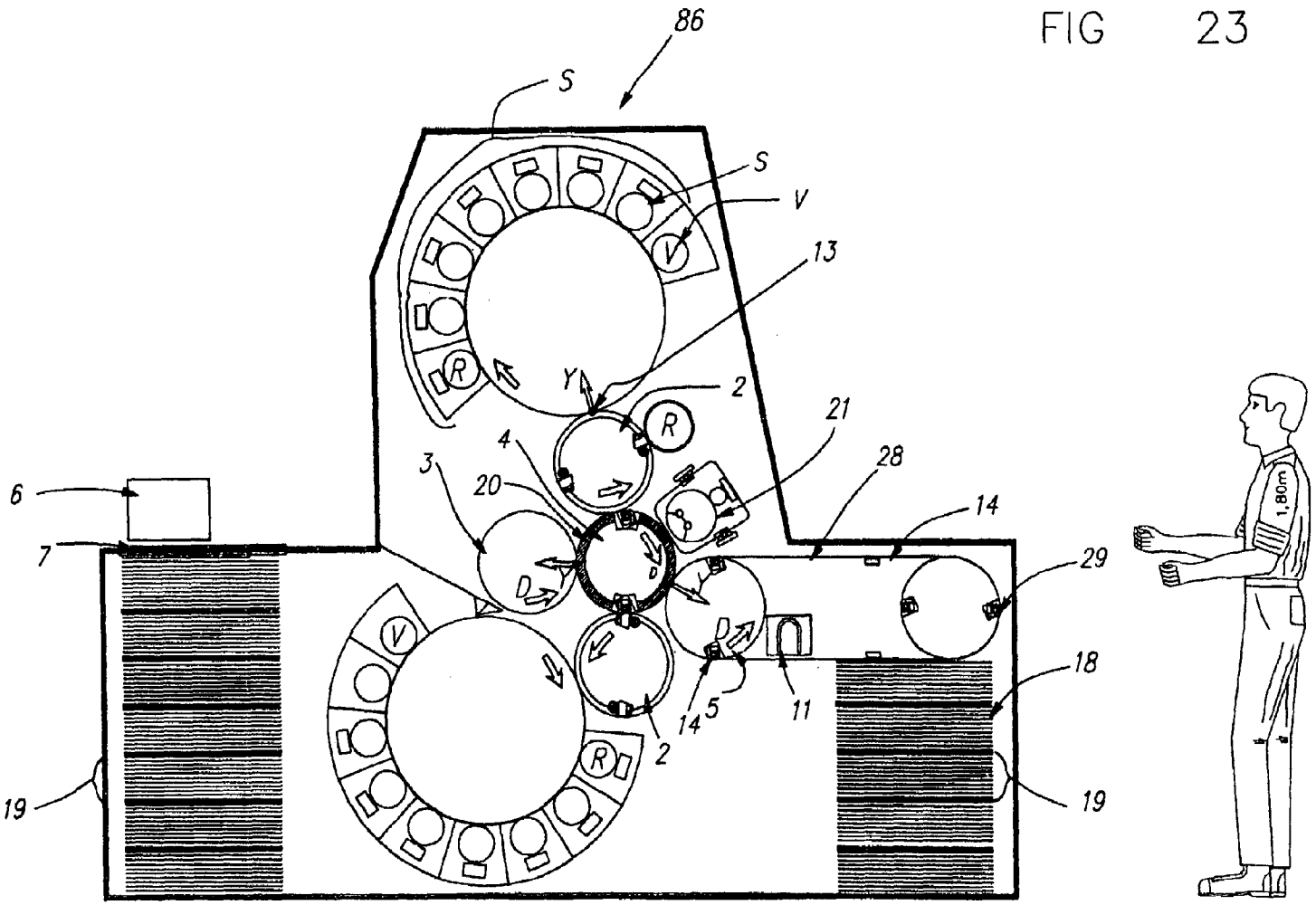
FIG. 23 shows a side view of a digital printing machine with transfer drum or common photo conductor drum.

FIG. 23 shows a digital duplex printing machine 86 (like FIG. 22), wherein a transfer drum 81 or a common photo conductor drum 81 for collecting the individual colors is disposed upstream of the intermediate cylinder 2, which is provided with rubber blankets.

Figure 24:
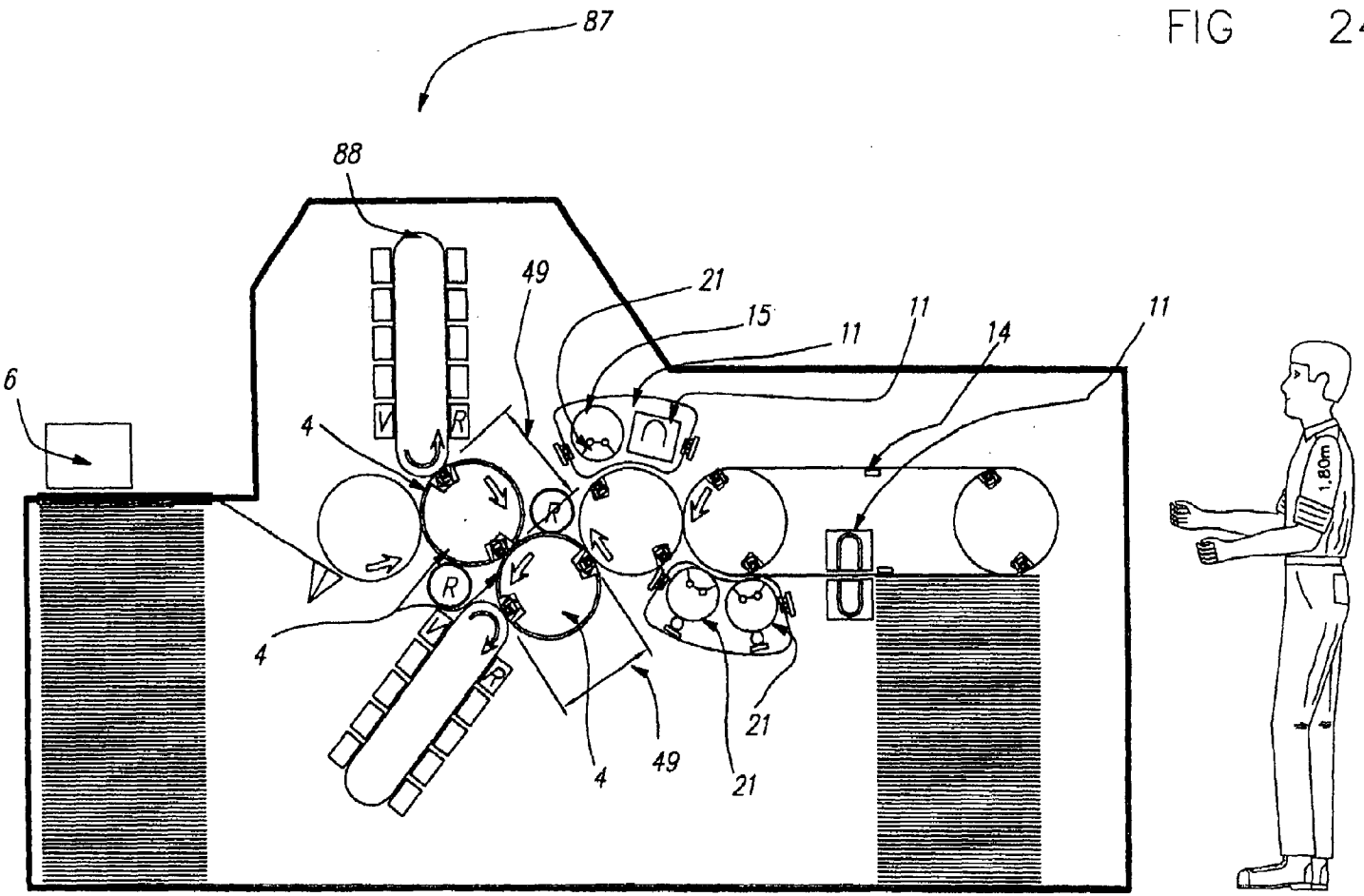
FIG. 24 shows a side view of a digital printing machine with formatted transfer band.

FIG. 24 shows a digital printing machine 87 for duplex printing, wherein the transfer band 88 is format-dependent and the counter pressure cylinder 4 has sheet-holding grippers, with the gripper-receiving recess (not shown) being provided on the periphery of the rubber band.

Figure 25:
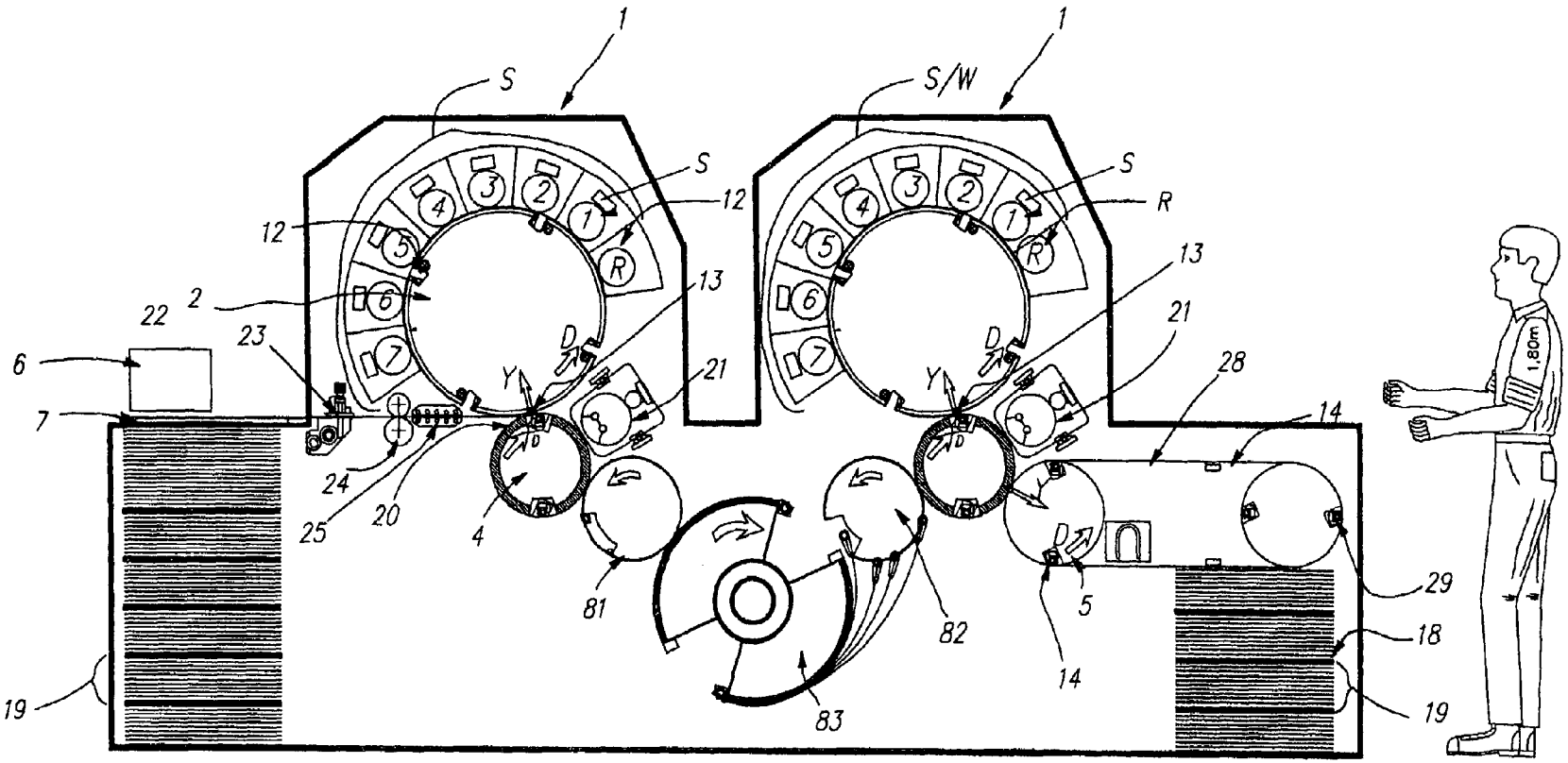
FIG. 25 shows a view of an illustrating cylinder with bearer rings.

FIG. 25 shows a digital printing machine with 2 printing mechanisms 1 (as in FIG. 1) with intermediate turning system 81, 82, 83. Two times seven colors can be printed on the first side or seven colors on each of the first and second sides.

Figure 26:
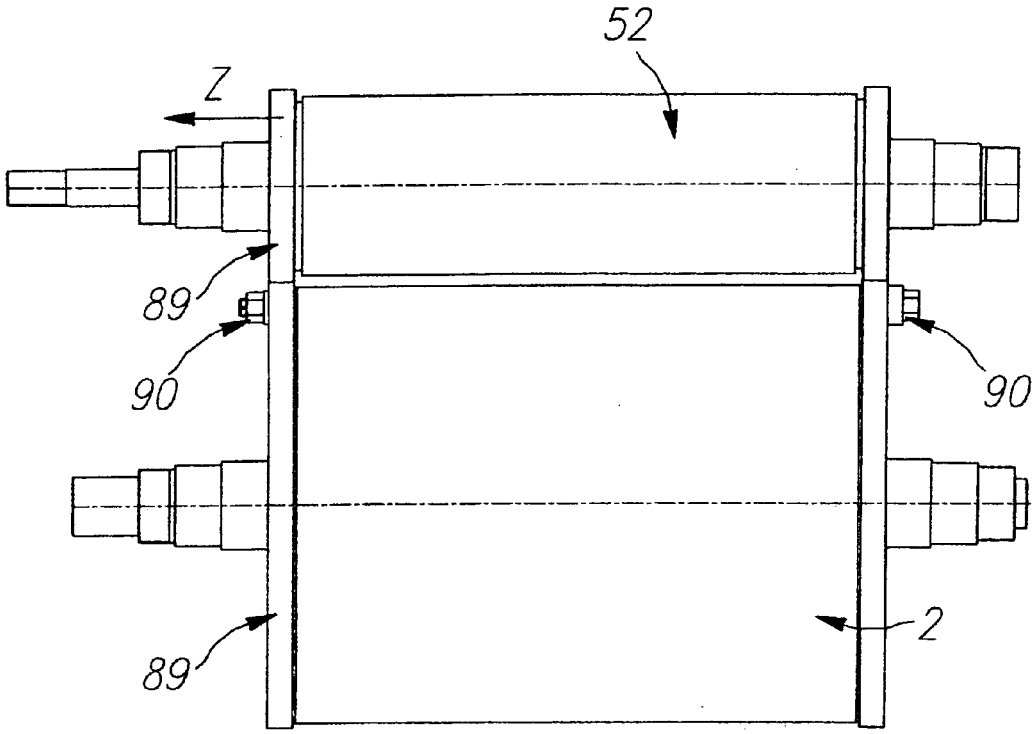
FIG. 26 shows a detailed view of FIG. 25.

FIG. 26 shows an illustrating cylinder 52 with bearer rings 89 on both sides which can be dismounted quickly on one side of the illustrating cylinder (arrow Z).

The intermediate cylinder 2 is also shown with bearer rings 89 and tensioning device for the rubber blanket 90.

Figure 27:
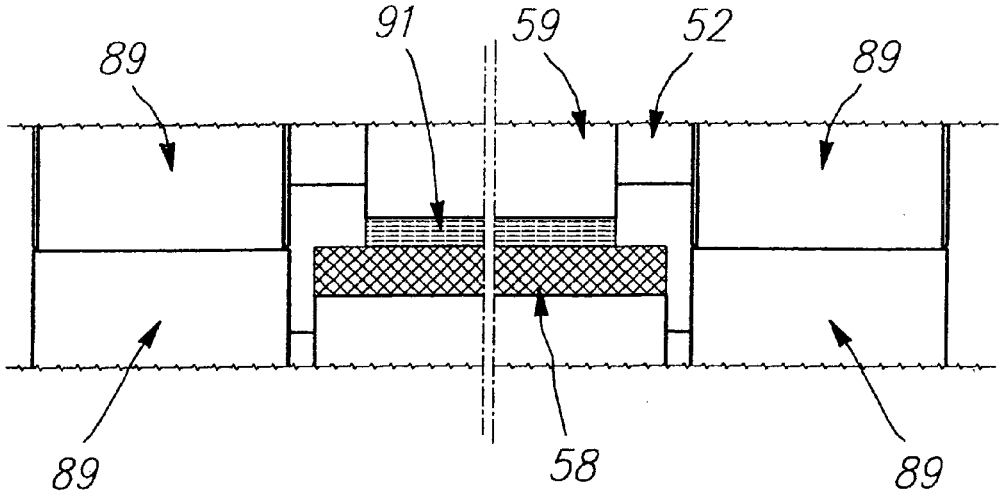
FIG. 27 shows a detailed view of FIG. 26.

FIG. 27 shows a detail of FIG. 26 with rubber blanket 58 and photo conductor coating 91 or photo conductor sleeve 91.

LIST OF REFERENCE NUMERALS

1. satellite printing machine
2. intermediate image transfer cylinder with channels
3. supply cylinder with gripper strip
4. counterpressure cylinder with gripper
5. delivery cylinder with gripper
6. sheet feeder
7. alignment table

8. swinging gripper
9. cassette unit for pre-print
10. coating system
11. dryer
12. printing blanket tensioning system
13. printing point
14. gripper system
15. cassette unit e.g. for finishing
16. fixing system (format-related)
17. sunk gripper system
18. sheet delivery
19. printing material cassette
20. surface area for fixing
21. cassette unit silicon and lacquer coating
22. gripper opening or tensioning channel
23. side lay mark
24. advance rollers
25. double corona chamber
26. servo drive printing machine
27. servo drive finishing station
28. delivery chain
29. chain wheel delivery
30. contact-less gearing
31. without gearing
32. gearing connection without play
33. female mold
34. male mold
35. punching and grooving device
36. embossing and foil device
37. side post cassette
38. anilox illustrating cylinder
39. chamber doctor
40. lacquer application roller
41. side post of the machine frame
42. open linear ball bearing
43. support rail with traverse
44. support strut
45. support rail
46. cam roller
47. gripper opening
48. tensioning channel
49. 7 o'clock position
50. inline finishing unit e.g. for folding
51. cassette unit for imaging
52. illustrating cylinder
53. toner supply unit
54. cassette in working position
55. cassette in service position towards the operator side
56. cassette in service position towards the drive side
57. material to be printed
58. tensioned rubber blanket
59. cylinder body
60. tensioning strip.
61. gripper back
62. tensioning slit
63. tensioning direction
64. gripper support
65. glued rubber blanket
66. inline further processing
67. delivery blanks
68. delivery punched sheets
69. disposal in upward direction
70. disposal towards the cylinder interior
71. disposal in downward direction
72. cleaning cassette, back side print
73. satellite printing mechanism for second print
74. rubber coated counterpressure cylinders
75. sunk gripper zone
76. pre-stacking means
77. height adjustment
78. lateral displacement
79. suction head
80. turning drum system
81. transfer drum
82. turning drum
83. storing drum
84. printing machine with central counterpressure cylinder
85. printing machine with transfer band
86. printing machine with transfer drum or common photo conductor drum
87. printing machine with format-related transfer band
88. transfer band
89. bearer ring
90. tensioning device rubber blanket
91. photo conductor coating or photo conductor sleeve
92. stop drum abutment
C arrow paper transport direction
S satellite printing mechanisms for front side print
D direction of rotation in the cassette
G arrow displacement finishing station
W satellite printing mechanisms for back side print
K arrow lateral adjustment in cassette
R cleaning systems in cassette
Y arrow radial printing feed adjustment
V pre-finishing/lacquer application format-free
Z arrow dismounting direction bearer ring

I claim:

1. A digital printing machine for printing a sheet, the machine comprising:

at least one digital printing mechanism comprising at least one illustrating cylinder having free format in a peripheral direction;

at least one format dependent intermediate image transfer cylinder cooperating with a respective one of said at least one digital printing mechanism for indirect printing, said intermediate cylinder being at least partially covered with an elastic material for image transfer under pressure onto the sheet, a periphery of said intermediate cylinder having at least one recess;

a counterpressure cylinder cooperating with said intermediate cylinder; and at least one gripper cooperating with said counterpressure cylinder for holding the sheet, said at least one gripper having mechanical fingers structured and disposed for acceptance within a respective one of said at least one recess of said intermediate cylinder.

2. The digital printing machine of claim 1, further comprising a transfer band and/or a transfer cylinder disposed between said digital printing mechanism and said intermediate cylinder.

3. The digital printing of claim 1, wherein at least four digital printing mechanisms are provided for at least one of front and back side printing.

4. The digital printing machine of claim 3, wherein said digital printing mechanisms are disposed like satellites about one of said intermediate cylinder, a transfer band, and a transfer cylinder.

5. The digital printing machine of claim 4, comprising satellite printing mechanisms and conditioning cassettes each form a cassette-shaped construction unit which can be displaced towards an operating and/or drive side of the machine from a working position into a service position.

6. The digital printing machine of claim 1, wherein each one of said at least one digital printing mechanisms cooperates with its own said at least one intermediate cylinder.

7. The digital printing machine of claim 1, comprising digital printing mechanisms for front and back side printing with a same construction.

8. The digital printing machine of claim 1, further comprising an anilox type illustrating cylinder having chamber doctors for applying powder or liquid toner.

9. The digital printing machine of claim 1, wherein for changing a format, said intermediate cylinder and said counterpressure cylinder are structured for displacement either individually or as an assembly, wherein said at least one digital printing mechanism is independent of format and said intermediate cylinder is designed for several standard formats.

10. The digital printing machine of claim 1, wherein said intermediate cylinder is a rubber blanket cylinder.

11. The digital printing machine of claim 10, wherein said intermediate cylinder has gripper recesses accommodating tensioning systems for tensioning and re-tensioning of printing blankets.

12. The digital printing machine of claim 1, wherein said illustrating cylinder has bearer rings which can be quickly dismounted for rapid replacement of illustrating sleeves.

13. The digital printing machine of claim 1, further comprising a format-variable sheet turning device having at least one transfer cylinder which can be operated at different speeds.

14. The digital printing machine of claim 1, further comprising several printing systems having differing printing methods without format and/or with predetermined format and structured for use with integrated conditioning, coating, fixing, drying and renewed moistening devices.

15. The digital printing machine of claim 1, wherein said intermediate cylinder comprises sinking grippers.

16. The digital printing machine of claim 1, wherein said illustrating cylinder has a smaller circumference than a maximum printing format in a peripheral direction of the printing machine.

17. The digital printing machine of claim 1, wherein multicolored image transfer is carried out in a single shot printing gap run and in a single pass machine run for at least one of a front and a back side print.

* * * * *